US005200762A

United States Patent [19]

Katano et al.

[11] Patent Number: 5,200,762

[45] Date of Patent: Apr. 6, 1993

[54] IMAGE FORMING APPARATUS

[75] Inventors: Yasuo Katano; Yasuyuki Okada, both of Yokohama; Takeshi Takemoto, Yamato; Akira Oyamaguchi, Yokohama; Yoshio Watanabe, Kawasaki, all of Japan

[73] Assignee: Ricoh Company, Ltd., Tokyo, Japan

[21] Appl. No.: 690,584

[22] Filed: Apr. 24, 1991

[30] Foreign Application Priority Data

Apr. 25, 1990 [JP] Japan ..... 2-111398
May 2, 1990 [JP] Japan ..... 2-116172

[51] Int. Cl.[5] ..... B41M 5/26

[52] U.S. Cl. ..... 346/76 R; 346/135.1; 346/76 PH

[58] Field of Search ..... 346/76 PH, 76 R, 135.1

[56] References Cited

U.S. PATENT DOCUMENTS 4,838,940 6/1989 Kan et al. ..... 346/76 R
4,920,361 4/1990 Arahara et al. ..... 346/76 R
4,962,389 10/1990 Kan et al. ..... 346/76 R

*Primary Examiner*—Benjamin R. Fuller
*Assistant Examiner*—Huan Tran
*Attorney, Agent, or Firm*—Oblon, Spivak, McClelland, Maier & Neustadt

[57] ABSTRACT

An image forming apparatus comprising a recording medium having a recording layer which has a characteristic in which a receding contact angle decreases when the recording layer is heated in a condition where the recording layer is in contact with a liquid, the recording medium being moved by an external driving mechanism in a predetermined direction, a supplying head for supplying a liquid to a predetermined area on a surface of the recording layer of the recording medium, the supplying head comprising a narrow path for leading the liquid to the surface of the recording layer due to a capillary attraction, and a thermal head for selectively heating the surface of the recording layer of the recording medium in accordance with image information, wherein an area on the surface of the recording layer is heated and brought in contact with the liquid so that the area changes to a liquid adhesive area, and wherein a visible image corresponding to the image information is formed on the surface of the recording layer when a recording agent is adhered to the liquid adhesive area.

13 Claims, 20 Drawing Sheets

IMAGE FORMING APPARATUS

BACKGROUND OF THE INVENTION

The present invention generally relates to an image forming apparatus, and more particularly to an image forming apparatus comprising a recording medium having a characteristic in which a receding contact angle decreases when the recording medium is heated in a condition where the recording medium is in contact with a contact material such as a liquid or the like.

An offset printing method using a printing plates without water (water for moisturizing) is a typical one of methods in which a recording medium is divided into areas where it is easy for liquid to adhere thereto and area where it is hard for the liquid to adhere thereto. However, in this offset printing method, it is difficult to incorporate a process for manufacturing printing plates from original plates and a process for printing from the printing plates into a single apparatus. This makes it difficult to have a compact printing apparatus.

For example, even in a case of relatively compact offset printing apparatus, a plate making apparatus and a printing apparatus are separated.

To eliminate this fault of the offset printing method, there has been proposed a recording method and apparatus in which areas where it is easy for the liquid to adhere thereto and areas where it is hard for the liquid to adhere thereto ban be formed in accordance with image information and in which the recording medium can be repeatedly used ( a process for forming an image is reversible). The following are some of these.

(1) Water-soluble developing method

After a charge has been applied from an external device to a hydrophobic photo-electric layer, a medium having the hydrophobic photo-electric layer is exposed so that a pattern having hydrophobic portions and hydrophilic portions is formed on the surface of the hydrophobic photo-electric layer. Then, a water soluble developing solution adheres to only the hydrophilic portions and is transferred to a paper or the like. Such methods and apparatus are disclosed in Japanese Patent Publication Nos.40-18992, 40-18993 and 44-9512 and Japanese Patent Laid Open Publication No.63-264392, etc.).

(2) Method using a photo-chemical response of a photo-chromic material

In this method, an ultraviolet light is irradiated to a layer which contains a material such as a spiropyran or an azo dye so that a photo-chemical reaction occurs to make the photo-chromic material hydrophilic. Such method and apparatus are described in "Japanese Journal of Polymer Science and Technology" Vol.37, No.4 page 287, 1980).

(3) Method using an action of an internal biasing forces

In this method, amorphous substances and crystalline substances are formed in a recording medium by a physical transformation, so that portions where it is easy for a liquid ink to adhere thereto and portions where it is hard for the liquid ink to adhere thereto are formed on the recording medium. An example of such is disclosed in Japanese Patent Laid Open Publication No.54-41902.

According to the previously described method (1), after the water-soluble ink is transferred to the paper or the like, the hydrophilic portions are removed by removing the charge so that it is possible to record other image information. That is, one original plate (photo-electric member) can be repeatedly used for printing images. However, in this method, an electrophotography process is basically used, so that a long time is required for carrying out the process involving steps of charging, exposing, developing, transferring and discharging. Therefore, it is difficult to make an apparatus compact, to reduce its cost and to make an apparatus in which it is unnecessary to maintain.

In the method (2) described above, it is possible to freely control the reversibility of the hydrophilic and hydrophobic properties by selective irradiation of ultraviolet and visible light. However, since a quantum efficiency is very small, a response time is extremely long and a recording speed is low. In addition, there is also a fault of image instability. Therefore, this method has still not put into practical use.

Furthermore, an information recording member (the recording medium) which is used in the method (3) has stability after an image is formed thereon, but there are occasions structural transformation occurs in the information recording member due to temperature changes prior to the recording. That is, the method (3) has a disadvantage in that it is difficult to maintain the image on the information recording member. In addition, when recorded information patterns is removed, a thermal pulse must apply to the information recording member and then it is necessary to rapidly cool the information recording member. Therefore, it is difficult to perform frequent repetition of image formation.

SUMMARY OF THE PRESENT INVENTION

Accordingly, a general object of the present invention is to provide a novel and useful image forming apparatus.

A more specific object of the present invention is to provide an image forming apparatus in which an image can be easily repeatedly formed on the surface of the recording medium.

Another specific object of the present invention is to provide an image forming apparatus in which a liquid such as a recording agent required for forming an image can be stably supplied to the surface of the recording medium.

The above objects of the present invention are achieved by an image forming apparatus comprising: a recording medium having a recording layer having a characteristic in which a receding contact angle decreases when said recording layer is heated in a condition where said recording layer is in contact with a liquid, said recording medium being moved by an external driving mechanism in a predetermined direction; supplying means, coupled to said recording medium, for supplying a liquid to a predetermined area on a surface of said recording layer of said recording medium, said supplying means comprising a narrow path for leading the liquid to the surface of said recording layer due to a capillary attraction; and heating means, coupled to said recording medium, for selectively heating the surface of said recording layer of said recording medium in accordance with image information, wherein an area on the surface of said recording layer is heated and brought in contact with the liquid supplied by said supplying means so that the area changes to a liquid adhesive area to which the liquid can be easily adhered due to the decreasing of the receding contact angle, and wherein a visible image corresponding to the image information is formed on the surface of said recording layer when a recording agent is adhered to the liquid adhesive area.

Additional objects, features and advantages of the present invention will become apparent from the following detailed description when read in conjunction with the accompanying drawings.

DETAILED DESCRIPTION OF THE INVENTION

Figure 1A:
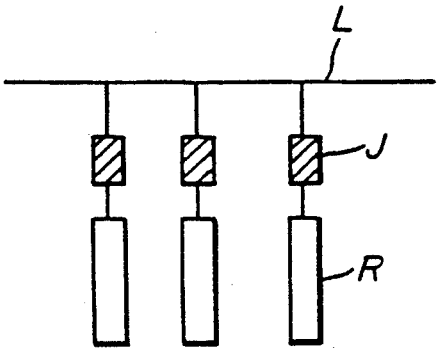
FIGS. 1A through 1D are views indicating models of the structure of a material having a surface sulf-orientation function.

The inventors of the present invention carried out much research and investigation regarding a novel recording method in which the faults described for the conventional technologies had been eliminated. As a result of this, the inventors discovered that a member having the following characteristics is effective as a recording medium.

When an area on the surface of the member is heated in a condition of being in contact with the liquid and then cooled, a receding angle of the area becomes smaller. After that, when the area is heated in a condition in which the liquid has been removed, the receding angle of the area becomes larger and returns to an original value. The receding angle of the area can be controlled in accordance with a temperature of the heated area.

One of the members having the above characteristic is a first member (1) in which the surface portion thereof includes an organic compound having a surface self orientation function with a hydrophobic group, or a second member (2) in which the surface portion thereof is an organic compound having the hydrophobic group which is oriented to the surface.

The "surface self orientation function" in the first member (1) is defined as a function whereby the hydrophobic group at the surface is oriented towards the side of the air (i.e. the side with the free surface) when a solid comprising a base member and an organic compound formed on the base member or a solid organic compound is heated in the air. This definition is also used for the second member (2). In general, an organic compound offers a phenomena in which a hydrophobic group is easily oriented towards the side of a hydrophobic atmosphere. As the orientation is towards the side at which the interfacial energy of the solid-gas boundary decreases, the above phenomena occurs. In addition, this phenomena is remarkable for the longer the molecular chains of the hydrophobic group, because the larger the molecular chain the mobility of the molecule becomes larger.

More specifically, in a case of a molecule which has a hydrophobic group at an end thereof (i.e. a molecule in which the surface energy is low), the hydrophobic group is easily oriented in a direction of the side of the air (i.e. the side with the free surface). In the same manner, in a case of chain molecules which include $-(CH_2)_n$, $-(CH_2)_n$ portions are flat and easily oriented. In addition, in molecules which include

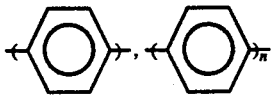

portions also have a flat structure and are easily oriented. Especially, the chain molecules including a chemical element in which an electronegativity is large, such as a fluoride, have a large self aggregation. In the chain molecules, a mutual molecular chains are easily oriented.

To summarize the results of these investigations, in a chain molecule which includes a molecule having a large self aggregation or a molecule having a flat structure and has the hydrophobic group at an end thereof, or in an organic compound including the above chain molecule, the surface self orientation function is large.

As is clear from the preceding discussion, there is a relationship between the surface self orientation and the receding contact angle. In addition, there is also a relationship between the receding contact angle and the liquid adhesiveness. That is, the adhesion of the liquid to the surface of the solid mainly occurs due to a tacking force for tacking the liquid at the surface of the solid. The tacking force can be regard as a type of friction which is generated when the liquid slides against the surface of the solid. Thus, in this invention, the "receding contact angle" $\theta_r$ can be denoted by the following formula.

$$\cos\theta_r = \gamma\cdot(\gamma_s - \gamma_{sl} - \pi_e + \gamma_f)/\gamma_{lv}$$

where:

$\gamma$: surface tension of a solid in a vacuum $\gamma_{sl}$: surface tension at the solid-liquid interface $\gamma_{lv}$: surface tension of the liquid in a condition in which the liquid is in contact with a saturated vapor $\pi_e$: equilibrium surface tension $\gamma_f$: friction force $\gamma_s$: surface tension of a solid without an absorption layer The above formula is disclosed by Saito, Kitazaki et al, "Japan Contact Adhesive Association Magazine" Vol.22, No.12, No.1986.

According to the above formula, when the receding contact angle $\theta_r$ decrease, the friction force $\gamma_f$ increases. That is, when the receding contact angle increases, it becomes hard for the liquid to slip on the surface of the solid. As a result, the liquid is adhered to the surface of the solid.

As can be assumed from the above mutual relationships, the adhesiveness of the liquid depends on the receding angle $\theta_r$. This receding angle $\theta_r$ depends on types of materials which have the surface self orientation function at the surface thereof. Hence, in the present invention, it is necessary to forming a predetermined pattern area on the recording medium (A) and/or to make a visible image corresponding to the pattern area by a recording agent, so that a member in which the surface thereof has the surface self orientation function is selected as the recording medium (A).

The recording medium (A) used in the present invention has a surface in which the receding contact angle $\theta_r$ decreases when the surface is in contact with the liquid in a condition of heating it. In addition, the receding contact angle $\theta_r$ is changed in accordance with the temperature of the heated area. When the receding contact angle is changed, the adhesiveness of the liquid at the area is changed. That is, dot size of an image is controlled by change of the receding contact angle. Thus, a gradational image can be formed on the recording medium (A). The gradational image formed on the recording medium (A) can be also transferred to a recording sheet.

The recording medium (A) can be of any shapes as long as the surface thereof has the nature described above. Thus, the recording medium (A) can be of a film shape. The recording medium (A) can also have a structure in which a coating film or the like having the nature described above is provided on the surface of a supporting member. The recording medium (A) can be structured by only one member in which the surface thereof has the nature described above.

An area where it is easy for the liquid to adhere thereto, which area is formed on the recording medium (A), becomes either a lipophilic area or a hydrophilic area in accordance with the type of contact material (B). Thus, either oil-soluble ink or water-soluble ink is used for printing an image.

FIGS. 1A through 1D indicate a classification of the types of materials or portions of materials "having a surface for which the receding contact angle $\theta_r$ decreases when the material is heated and brought into contact with a liquid". FIG. 1A indicates an example of a compound having a self-orientation function. This compound has a hydrophobic group on the side chains of the macromolecule polymer. The main chain L and the hydrophobic group R are linked by a linking group J.

Figure 1B:
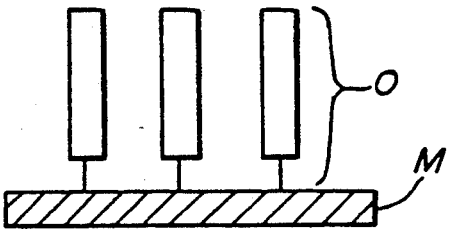
Figure 1C:
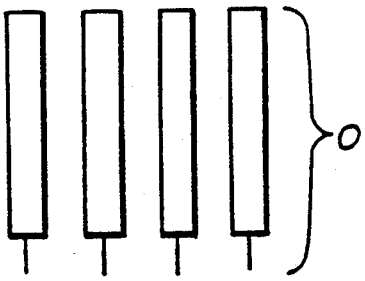

FIG. 1B indicates an example of a material in which the hydrophobic group in an organic compound are oriented towards the surface thereof. The compound O having the previously described hydrophobic group is formed by the physical or chemical linking to the surface of an organic or inorganic material M. FIG. 1C shows an example of a material which is made up of only the organic compound O having the hydrophobic group indicated in FIG. 1B.

Figure 1D:
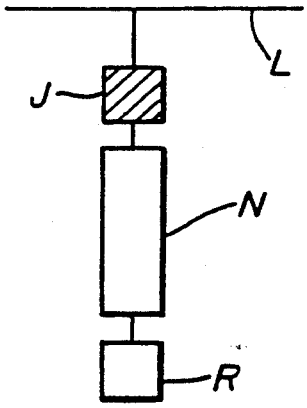

FIG. 1D indicates an example where the chain molecules are in a side chain of a macromolecule. The chain molecules and the main chain L are linked by the linking chain J. This is a compound in which each chain molecule has a molecular chain N having either a flat structure of a self-aggregation and the hydrophobic group R is linked at an end of the molecular chain N.

In the examples shown in FIGS. 1A and 1D, the main chain L of the macromolecule compound can either have a linear shape or a network structure.

In the example indicated in FIG. 1B, as in a case of a deposited Lngmuir-Blodgett film, it is also possible to use a compound O including a hydrophobic group and then deposit a compound O including a hydrophobic group on another one. In the example indicated in FIG. 1C, there is only a compound including a hydrophobic group, with there being no main chain L and no linking to an organic or inorganic material (M) or the like.

The previously described hydrophobic group should desirably have the end molecules as $-CH_3$, $-CF_3$, $-CF_2H$, $-CFH_2$, $-C(CF_3)_3$, $-C(CH_3)_3$ or the like. More desirably however, it is advantageous if this hydrophobic group has long molecules which have a high molecular mobility. Of these, the previously described hydrophobic group can be an alkyl group in which either a fluorine or a chlorine is substituted for at least one hydrogen thereof, which alkyl group has more than one —F and/or —Cl, such as $$-CF_2CF_2\underset{\underset{Cl}{|}}{C}FCF_2CF_2.$$

The above hydrophobic group can also be an alkyl group having a carbon number of 4 or more. An alkyl group in which either a fluorine (F) or a chlorine (Cl)

substituted for at least one hydrogen thereof can be used and it is more effective if an alkyl group in which a fluorine is substituted for at least one hydrogen thereof is used. It is further more effective that a compound has the polymer whose side chain includes fluorine.

The principle of this function is not yet perfectly understood but is assumed to be as described below.

First, it will be considered that the surface of a recording medium (A) formed by this compound described above has a surface on which the hydrophobic group is considerably oriented. Thus, this surface has a liquid repellency property (since the surface energy of the hydrophobic group is the smaller). In this state, when the surface of the recording medium (A) and the contact material (B) are brought into contact and heated, the heating causes the molecular motion of the hydrophobic group to increase and the recording medium (A) and the contact material (B) are interacted with each other. Thus, an orientation state of at least one portion of the recording medium (A) changes into another one (for example, the orientation is disordered). Then the changed state is maintained after the recording medium (A) is cooled. Even if the contact material (B) is either a vapor or a solid before heating, the contact material (B) in contact with the recording medium (A) becomes liquid in the state in which the recording medium (A) is being heated.

Prior to heating, because the hydrophobic group is oriented in the surface of the recording medium (A), the surface energy of the recording medium (A) is extremely low. However, by heating the recording medium (A) in the state where the contact material (B) is in contact therewith, the orientation is disordered and the surface energy increases. The receding contact angle $\theta_r$ is determined by the balance between the surface energy of the solid and surface energy of the liquid. If the surface energy of the solid is high, then irrespective of the type of liquid, the receding contact angle $\theta_r$ will become smaller. Thus, the adhesiveness with respect to the liquid will increase as a result.

Furthermore, after the orientation state in the surface of the recording medium (A) changes into another orientation state or a state in which the orientation is disordered, when the recording medium (A) is heated in a condition where there is no contact material (B), the interaction between the recording medium (A) and the contact material (B) does not occur, so that the recording medium (A) reverses to the former orientation state.

Accordingly, the contact material (B) is not one where it simply performs cooling after the surface of the recording medium (A) has been heated, but is one where there is some kind of the recording medium (A) for the change of state (either a state where there is an orientation different from the former orientation state or a state where the orientation has been disordered) to occur.

As has been described above, when the hydrophobic group of a member (compound) forming the surface of the recording medium (A) is an alkyl, an alkyl group in which either a fluorine or a chlorine is substituted for at least one hydrogen thereof, then it is necessary for the carbon number of the alkyl to be 4 or more. This carbon number which is 4 or more is thought to be the necessary number for active molecule motion when heating is performed, and for a certain degree of orientation of the alkyl on the surface of the recording medium (A). In addition, when the contact material (B) is heated along with the surface of the recording medium (A), it is thought that the molecules of the contact material (B)are incorporated into the molecules of the surface of the recording medium (A). Furthermore, an alkyl group including fluorine or chlorine which has a high electronegativity is used, then there is a large interaction with liquid and particularly liquids having polarity and so there is a larger change in the adhesiveness than in the case of a compound that includes an alkyl group in which there are not fluorine and chlorine. In addition, the alkyl group which includes fluorine has a strong self-aggregation and so the surface self-orientation function is also high. Still furthermore, the alkyl group which includes fluorine has a low surface energy and so have an excellent effect in prevention the surface of the recording medium (A) from being dirtied.

Moreover, the surface of the recording medium (A) has a liquid repellency effect. This may be described in terms of the surface energy of a solid. In the course of the investigation performed by the inventors, it was found that it is desirable as far as use for a recording method is concerned, for this surface energy to be 50 dyn/cm or less. When the surface energy of the recording medium (A) is greater than 50 dyn/cm, the surface of the recording medium is easily wet and it is possible to become dirty with the recording agent.

A detailed description will now be given of a compound forming the surface of the recording medium (A).

A compound in which an alkyl group (which can include fluorine and/or chlorine) is included in the side chain of a polymer can be preferred as the type of compound as shown in FIG. 1A or 1D. More specifically, monomers indicated in (I), (II), (III), (IV), (V), (VI) and (VII) are preferred.

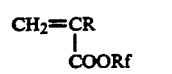
(I)

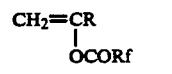
(II)

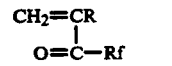
(III)

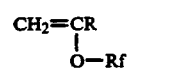
(IV)

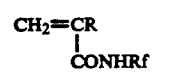
(V)

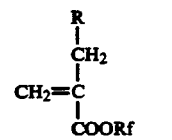
(VI)

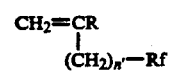
(VII)

R is either —H, —$CH_3$, —$C_2H_5$, —$CF_3$ or —$C_2O_5$.

Rf is either an alkyl group having a carbon number of 4 or more, a group including an alkyl group in which either a fluorine or a chlorine is substituted for at least one hydrogen thereof, or a hydrophobic group in which $-(CF_2)-_i$, $-(CH_2)-_i$ or

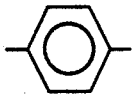

(where i≧4)

n' is an integer and equal to or greater than 1.

Other polymers are those indicated in (VIII), (IX) and (X).

(VIII)

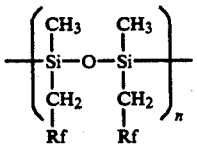

(IX)

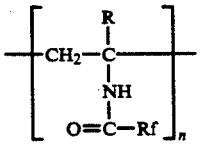

(X)

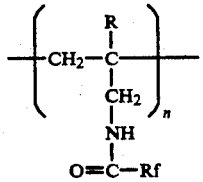

R is either —H, —$CH_3$, —$C_2H_5$, —$CF_3$ or —$C_2O_5$.

Rf is either an alkyl group having a carbon number of 4 or more, a group including an alkyl group in which either a fluorine or a chlorine is substituted for at least one hydrogen thereof, or a hydrophobic group in which —$CF_2$—$_i$, —$CH_2$—$_i$ or

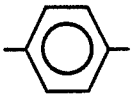

is provided in the molecule chain (where i≧4).

n is an integer and equal to or greater than 10.

In these (I) through, RF can be as indicated in to the following (1) through (20).

—$CH_2CF_2CHFCF_3$ (1)

(2)

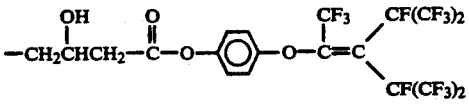

—$CH_2CH_2OC(=O)C_7F_{15}$ (3)

(4)

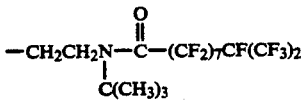

-continued

—$CH_2CH(OH)CH_2(CF_2)_4CF_3$ (5)

—$CH_2(CF_2)_{10}H$ (6)

$\leftarrow CF_2 \rightarrow_6 O—CF_2CF_3$ (7)

$\leftarrow CH_2 \rightarrow_4 NH—CF_2CF_3$ (8)

$\leftarrow CF_2 \rightarrow_6 CF_3$ (9)

$\leftarrow CH_2 \rightarrow_{10} C_8F_{17}$ (10)

—$CH_2N(C_2H_5)—SO_2C_9F_{17}$ (11)

$\leftarrow CH_2 \rightarrow_{10} N(CH_3)SO_2C_8F_{17}$ (12)

—$CH_2NHSO_2C_6F_{17}$ (13)

(14)

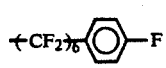

c.s-$CH_2CH_2$—$(CF_3)_6CF(CF_3)_2$ (15)

—$CH_2CF_2CF_2CF_3$ (16)

—$CH_2CH_2CH_2CH_2F$ (17)

—$(CH_2(CF_2)_6CF_3$ (18)

—$CH_2(CF_2)_5CF_3$ (19)

$\leftarrow CH_2 \rightarrow_3 CF_3$ (20)

The following material (XI) can be selected for particular consideration from the above compounds.

(XI)

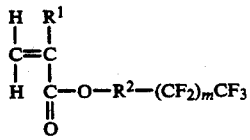

where $R^1$ is either hydrogen, —$C_nH_{2n+1}$ or —$C_nF_{2n+1}$ (n is an integer, n=1 or n≧2), $R^2$ is either —$(CH_2)_p$ (where p is an integer, p≧1) or —$(CH_2)_qN(R^3)SO_2$— (where $R^3$ is either —$CH_3$ or $C_2H_5$, q is an integer, q≧1), and m is an integer equal to or greater than 6.

Accordingly, the following compounds are given as the most desirable compound for use as the member for the surface of the recording medium (A) of the present invention.

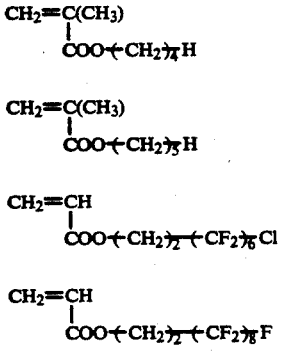

-continued $CH_2{=}CH$
$\quad|$
$\quad COO{-}(CH_2)_2{-}(CF_2)_6F$ $CH_2{=}C(CH_3)$
$\quad|$
$\quad COO{-}(CH_2)_2{-}(CF_2)_8F$ $CH_2{=}C(CH_3)$
$\quad|$
$\quad COO{-}(CH_2)_2{-}(CF_2)_6F$ $CH_2{=}CH$
$\quad|$
$\quad COO{-}(CH_2)_2N{-}SO_2{-}(CF_2)_9F$
$\qquad\qquad\quad|$
$\qquad\qquad C_2H_5$ $CH_2{=}CH$
$\quad|$
$\quad COO{-}(CH_2)_2{-}(CF_2)_9F$ $CH_2{=}C(CH_3)$
$\quad|$
$\quad COO{-}(CH_2)_2{-}(CF_2)_{10}{-}F$ $CH_2{=}CH$
$\quad|$
$\quad COO{-}CH_2CF_2CHFCF_3$ $CH_2{=}C(CH_3)$
$\quad|$
$\quad COO{-}(CH_2)_2{-}(CF_2)_9F$ $CH_2{=}CH$
$\quad|$
$\quad COOCH_2CH_2OC{-}(CF_2)_7F$
$\qquad\qquad\quad\|$
$\qquad\qquad\quad O$ $CH_2{=}CH$
$\quad|$
$\quad COOCH_2(CF_2)_7CF_3$ $CH_2{=}CH$
$\quad|$
$\quad COOCH_2(CF_2)_9CF_3$ Moreover, a copolymer made of some of monomers indicated in (I) (II) (III) (IV) (V) (VI) (VII) and (XI) and other monomers such as ethylene, vinyl chloride, styrene, butadien, isoprene, chloroprene, vinyl alkyl ether, vinyl acetate and vinyl alcohol can be also used as the compound forming the surface of the recording medium (A).

In addition, a copolymer is made of a monomer represented by the formula (XI) and at least one of the following monomers each having a functional group.

$CH_2{=}C(CH_3)COO(CH_2)_2OH$ $CH_2{=}C(CH_3)COOCH_2CH(OH)CH_3$ $CH_2{=}CHCOOCH_2CH(OH)C_8F_{17}$

As a result, many functional groups are formed in the copolymer. In this manner, the manufactured substance has excellent properties as crosslinking type of polymer. Either formaldehyde, dialdehyde, N-Methylol compounds, dicarboxylic acid, dicarboxylic acid chloride, bis-halogen compounds, bis epoxide, bis aziridine, diisocyanate and the like can be used as the crosslinking agent. The following is one example of a crosslinking polymer obtained in this manner.

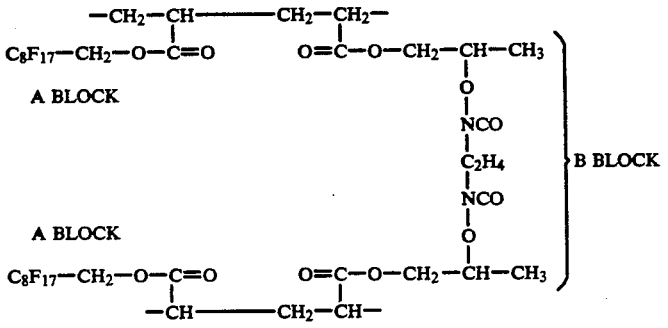

In the above formula, the A block is an alkyl group which brings on the previously described change in the thermal nature. The B block is the agent that crosslinks property of chain polymers (with diisocyanate being used as the crosslinking agent).

A liquid in which the above described copolymer and the crossliking agent are mixed is coated on a substrate, and then either heating or irradiating electrons or light with respect to the substrate coated the liquid, so that a crosslinked film is formed on the substrate.

The process for obtaining the polymer from the monomer is selected in accordance with materials from solution polymerization, electrolysis polymerization, emulsification polymerization, photo polymerization, radiation polymerization, plasma polymerization, graft polymerization, plasma-iniciated polymerization, vapor deposition polymerization and the like.

A description will now be given of the compound indicated in FIG. 1B.

It is desirable that One of the following materials indicated by (XII), (XIII) and (XIV) be used for making the compound.

$R_f{-}COOH$ (XII)

$R_f{-}OH$ (XIII)

$R_f{-}(CH_2)_nSiX$ (XIV)

where, $R_f$ is either an alkyl group in which a carbon number is 4 or more, a group including an alkyl group in which fluoride or chloride is substituted for at least one hydrogen thereof, a hydrophobic group in which $-(CF_2)_1$, $-(CH_2)_1$ or

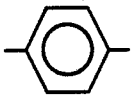

is included in the molecular chain (where $l \geqq 4$), m is an integer equal to or greater than 1, and X is either chlorine, methoxy group or ethoxy group.

On the above materials is physically absorbed or chemically connected to the surface of an inorganic material such as gold or copper or an inorganic material such as polyester or polyethylenterephthalate (and preferably the material has a surface energy of approximately 50 dyn/cm or less).

The following are specific examples of the materials in formula (XII), (XIII) and (XV).

$CF_3—(CF_2)_5—COOH$ $CF_3—(CF_2)_7—COOH$ $CF_3—(CF_2)_7—(CH_2)_2—OH$ $H—(CF_2)_{10}—COOH$ $H—(CF_2)_{10}—CH_2OH$ $F—(CF_2)_6—CH_2CH_2—Si(CH_3)_2Cl$ $CF_2Cl(CF_3)CF(CF_2)_5COOH$ $CF_3(CF_2)_7(CH_2)_2SiCl_3$

The compound indicated in FIG. 1C can have a structure where there is only the material of (XII), (XIII) or (XIV).

A description will now be given of the recording medium (A) formed of the above compound.

The configuration of the recording medium (A) is such that it is (1) formed by the previously described surface member itself, or (2) formed by the previously described surface member on a supporting member (preferably a supporting member having heat resistance). The above compound (surface member) which applies to (1) above have either a plate or film shape, or can also be formed as a cylinder. In this case, it is desirable for a film shape to have a film thickness of between 1 μm and 5 μm.

In a case of the compound pertaining to (2) above, it is permitted for the above described compound to permeate some distance into the supporting member. It is desirable that the film thickness of the recording medium (A) itself be from 30 Å to 1 μm. With respect to the thermal conductivity, a film thickness of between 100 Å and 10 μm is better, and with respect to the friction resistance, a film thickness of 10 μm to 1 mm is better. It is desirable that the heat resist temperature of the supporting member be between 50° C. and 300° C.

The shape of the supporting member can also be a belt shape, a plate shape or a drum shape. The shape of the supporting member can be selected in accordance with the usage of an image forming apparatus. In particular, drum shapes have the advantage of being able to ensure good dimesional accuracy. In a case of plate shapes, the size of the plate is determined in accordance with the size of the recording sheet to be used.

Moreover, when a mixture made of the above compound (material formed on the surface of the recording medium (A)) and other material, such as hydrophobic polymer or hydrophobic inorganic material is formed on the supporting member, there is the advantage of preventing dirtying of a background of the image at printing. In addition, in order to raise the thermoconductivity, metal powder or the like can be mixed in the above described compound. Furthermore, in order to increase the adhesiveness between the supporting member and the above described compound, a primer layer can be provided between the supporting member and the compound. The thermal resistance supporting member can be formed of a resin film, such as a polyimide film, a polyester film or the like, a glass, a metal such as Ni, Al, Cu, Cr, Pt or the like, or a metallic oxide. The surface of the supporting member can be smooth, rough or porous.

A description will now be given of the contact material (B).

The contact material (B) has been described above. The contact material (B) is either a liquid or a vapor from its initial state, or a solid which ultimately becomes a liquid at a temperature less than a temperature at which the receding angle $\theta_r$ of the recording medium (A) starts to decrease. Then, a liquid obtained by a condensation of the vapor wets the surface of the recording medium (A). At a temperature equal to or less than the temperature at which the receding contact angle $\theta_r$ starts to decrease, the solid changes into a liquid, generates a liquid, or generates a vapor. A liquid is obtained by the condensation of the vapor generated from the solid, and then the liquid wets the surface of the recording medium (A).

The contact material (B) is selected, for example, one of the following material.

In a case of the liquid, the contact material (B) is, in addition to the water, a water soluble liquid including electrolytes, n-butanol and other alcohols, glycerine, ethylene glycol and other multivalent alcohols, a liquid having polarity such as methyl ethyl ketone and other ketones, n-nonan, n-octane and liquids not having polarity such as other chain hydrocarbons, cyclohexane and other circular hydrocarbons, meta-xylene, benzene or other aromatic hydrocarbons. In addition, a substance which is mixture of the above materials is also suitable. Various types of dispersed liquids and liquid inks can also be used. The liquid having polarity are more suitable.

In a case of the vapor, the contact material (B) can be, in addition to the water, a vapor of the above material, particularly ethanol vapor and meta-xylene vapor and other vapors of organic compounds (including those that are mist state) can be used. A temperature of the vapors of organic compounds must be less than a melting point or a softening temperature of the compound which forms the surface of the recording medium.

In a case of the solid, the contact material (B) can be high-class fatty acids, low molecular weight polyethylene, macromolecules gel (poly acryl amido gel, poly vinyl alcohol gel), sillica gel, or hydrated compound.

As will be described later, when the contact material (B) is a "recording agent which contains a colorant" such as the above described liquid inks, the formation of the latent image and the developing of the image are performed simultaneously.

A description will now be given of heating means.

The heating means can be a heater, a thermal head or another type of contact heating device, but can also be a non-contact type of heating device which uses electromagnetic radiation (such as a laser light, infra-red radiation lamps or some of type of light which is irradiated from a light source and focussed through a lens system). In addition, electron beam irradiation or ultraviolet light irradiation can also achieve the process of the present invention if the recording medium (A) can be effectively heated.

Figure 2B:
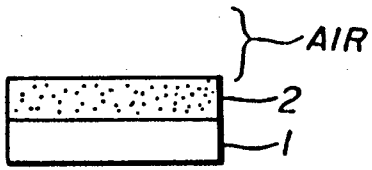
FIGS. 2A, 2B, and 3 are views for describing the fundamental aspects of the image recording process according to the present invention.
Figure 2A:
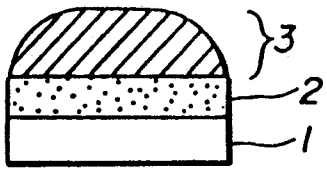

In FIG. 2A, a film 2 of the above described compound is formed on a substrate 1 so as to form the surface of the recording medium (A), and a liquid 3 of the contact material (B) exists on the film 2. In this state, when the film is heated, the receding contact angle $\theta_r$ on the surface of the film 2 decreases so that wetting appears on the surface of the film 2. That is, on the surface of the film, the adhesion of the liquid is recognized. In addition, when the film 2 having the adhesion of the liquid is heated again in a vacuum or in an atmosphere of an inert gas (FIG. 2B), the receding contact angle $\theta_r$ increases and then the water repellency can be recognized on the surface of the film 2.

A phenomena similar to the above phenomena is disclosed in Japanese Patent Publication No. 54-41902, described above. However, this disclosed process differs from the process of the present invention in that the recording material is effectively disordered and in that the mechanism obtains a layer of an amorphas memory substance. That is, in the present invention, it is not possible to have a change in the state of the surface of the recording medium (A) without the contact material (B). In addition, in the process disclosed in Japanese Patent Publication No.54-41902, it is not possible to obtain the reversible change by a simple operation.

Figure 3:
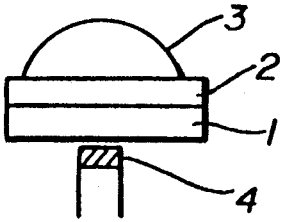

As shown in FIG. 3, when the film 2 is heated in accordance with a image information signal in a condition in which the liquid 3 is in contact with the surface of the film 2, the adhesion property of the liquid is obtained on a portion, which is heated, of the film 2. In this case, a heater 4 turns on and off in accordance with the image information signal.

Figure 4:
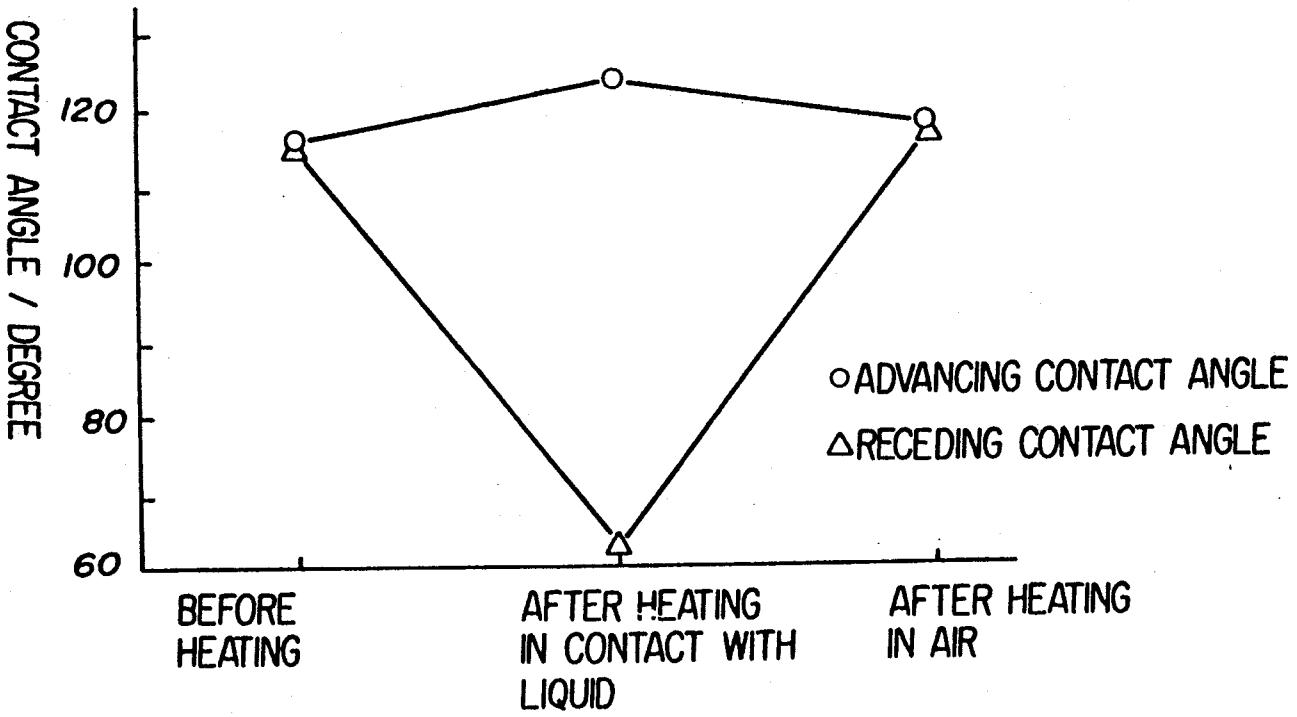
FIG. 4 is a graph indicating the changes in the advancing contract angle and the receding contact angle in the surface of the recording medium.

FIG. 4 is a graph illustrating contact angles of a water-soluble liquid on the film 2 prior to heating the film 2 and after heating film 2 in a condition where the water-soluble liquid is in contact with the film 2. FIG. 4 is also illustrates contact angles of the water-soluble liquid when the film 2 is further heated in air. In FIG. 4, ○ denotes the advancing contact angle, and Δ denotes the receding contact angle.

In general, when the receding contact angle is a high value equal to or greater than 90, the surface of the substance exhibits liquid repellency. When the receding contact angle is a low value less than 90°, the surface of the substance exhibits liquid adhesion.

In a state where the contact material (B) is contact with the recording medium (A), the recording medium (A) should be heated at a temperature between 50° C. and 250° C., but preferably should be heated at a temperature between 80° C. and 150° C. The heating time should be in the range of 0.5 msec to 1 sec., but preferably should be in the range of 0.5 msec to 2 msec. The heating timing is determined as follows. In a case of forming a latent image, ① when the surface of the recording medium (A) is heated, and then the temperature of the recording medium is not less than a predetermined temperature, the contact material (B) is brought into contact with the recording medium (A). ② In a state where the contact material (B) is in contact with the surface of the recording medium (A) (the liquid is in contact with the surface of the recording medium), the surface of the recording medium (A) is heated. Either the above ① or ② can be carried out. In a case of erasing the latent image, the recording medium (A) should be heated at a temperature between 50° C. and 300° C., but preferably should be heated at a temperature between 100° C. and 180° C. The heating time should be in a range of 1 msec. to 10 sec, but preferably should be in a range of 10 msec. to 1 sec.

A detailed description will now be given of means for recording image information on the surface of the recording medium (A).

Figure 5A:
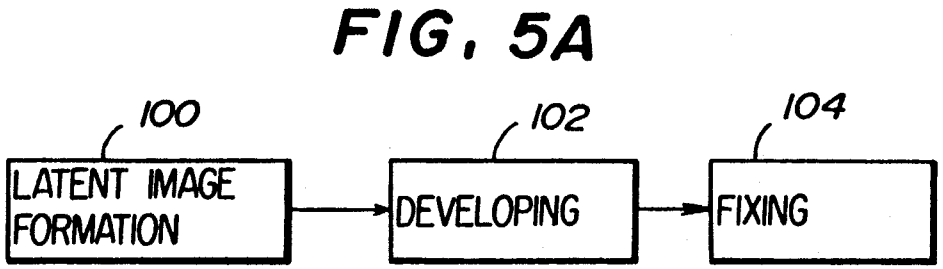
FIGS. 5A, 5B and 5C are block diagrams illustrating recording processes according to the present invention.

As shown in FIG. 5A, the surface of the recording medium (A) is heated in accordance with a image information signal in a condition where a liquid is provided on the surface of the recording medium (A) or in a vapor atmosphere, and thus liquid adhesion areas are formed on the surface of the recording medium (A) (latent image formation step 100). After this, a recording agent is brought into contact with the surface of the recording medium (A) so that the recording agent adheres to the latent image portion (developing step 102). Then, the image formed by the recording agent is fixed on the surface of the recording medium (A) (fixing step 104). The above process for recording the image is often referred to as a direct recording process.

Figure 5B:
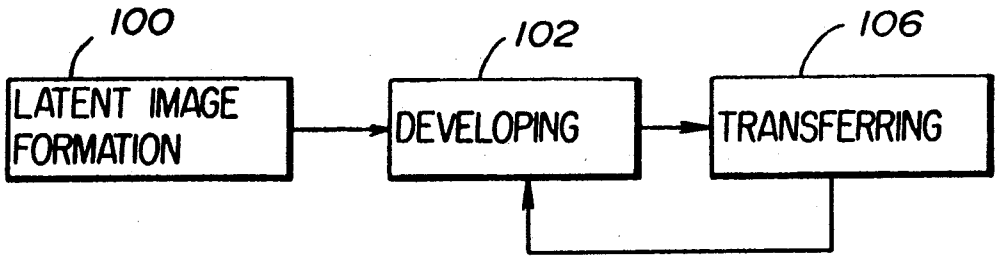
Figure 5C:
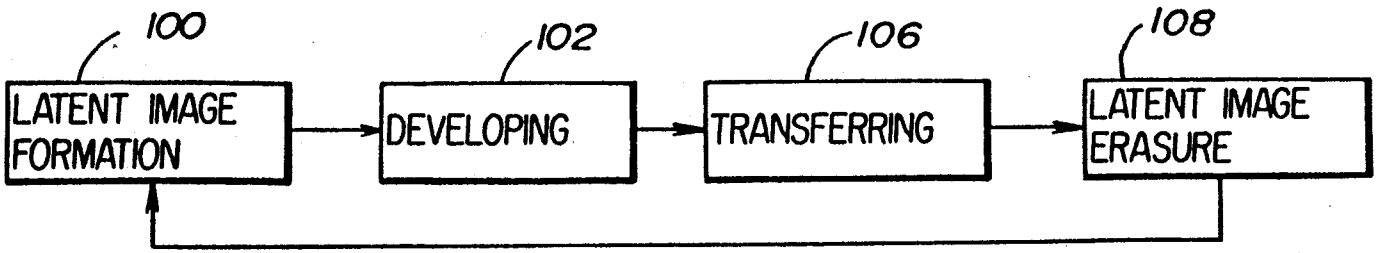

As shown in FIG. 5B, the surface of the recording medium (A) is heated in accordance with the image information signal in the condition where the liquid is contact with the surface of the recording medium (A) or in the vapor atmosphere, and thus liquid adhesion areas are formed on the surface of the recording medium (A) (latent image formation step 100). After this, the recording agent is brought into contact with the surface of the recording medium (A) so that the recording agent adheres to the latent image portion (developing step 102). Then, the image formed by the recording agent is transferred to a recording sheet (transferring step 106). This process for recording image on the recording sheet is often referred to as an indirect recording process. Furthermore, if the step where the recording agent is brought into with the latent image portion on the surface of the recording medium (A) and the step where the image formed by the recording agent is transferred to the recording sheet are sequentially repeatedly carried out, the images are successively formed on the recording sheets. That is, a printing process in which the recording medium (A) is used as a printing plate is obtained.

As shown in FIG. C, after the latent image formation step 100, the developing step 102 and the transferring step 106 are sequentially carried out, the surface of the recording medium (A) is heated without the liquid or the vapor so that the latent image is erased from the surface of the recording medium (A). That is, an image forming process in which it is possible to repeatedly form different latent image on the surface of the recording medium (A). This process for repeatedly forming the image on the recording medium (A) is referred to as a repeat recording process.

A description will now be given of an apparatus for recording an image in accordance with the above described process.

If the recording medium (A) has the surface on which the receding contact angle decreases when the liquid is brought into contact with the surface and the surface is heated, the recording medium (A) can have any shape. The surface having the above characteristic will be hereinafter termed the "film 2" or the "surface of the recording medium (A)". The recording medium (A) can be either a rigid cylindrical shape or a flexible film shape. A recording medium with a rigid cylindrical shape (i.e. the film 2 is formed on the surface of the rigid cylinder) can accurately move, so that a position where the image is formed on the surface of the recording medium (A) is accurately controlled. Thus, it is desirably that the rigid cylinder be used as the recording medium. This recording medium (A) is manufactured by forming the film 2 on a substrate. A formed member of a material which has the above described characteristic can even be the recording medium (A) itself. In particular, as the formed member is generally mechanically weak, it is desirably that the film 2 be formed on the substrate. Even in a case where the formed member is used as the recording medium (A), the film 2 forms the surface of the formed member.

In a case where the substrate of the recording medium (A) is formed of resin, as the substrate has a poor heat conductivity, a time required for heating the surface of the recording medium is heated and obtaining the adhesive of the liquid is relatively long. Therefore, a good heat conductor is used for either all or a part of the substrate.

Figure 6B:
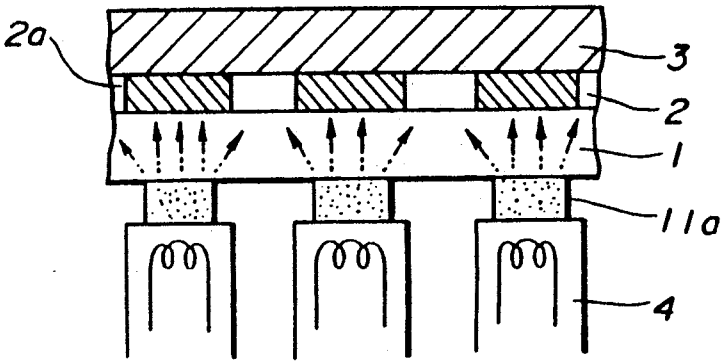
FIGS. 6A through 14 are views illustrating examples of an apparatus for forming the image in accordance with the recording process.
Figure 6A:
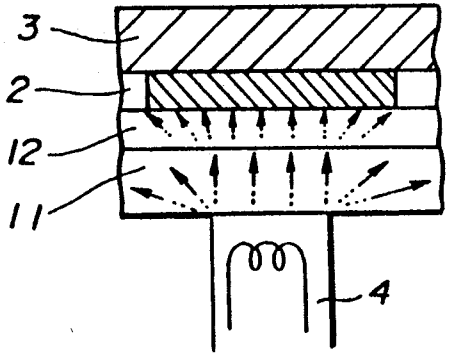

In FIG.6A, a good heat conductor such as a metal is used as the substrate (metal substrate 11). An organic thin film 12 is formed on the metal substrate 11 by vapor evaporation, and the film is formed on the organic thin film 12. Due to this stacked structure, it is possible to improve a speed of thermal conductivity in the vertical direction. The organic thin film 12 is, for example, made of polyimide, polyester, phtalocyanine or the like. This structure is thought to be sufficient in a case where the printing dots are relatively large. However, this mechanism shown in FIG. 6A is not suitable for rapidly printing a dot image since an area having liquid adhesive enlarges by the dispersion of the heat, supplied from the heater 4, in directions parallel to the surface of the film 2. A structure shown in FIG. 6B prevents the heat provided from each heater 4 from dispersing in the directions parallel to the surface of the film 2, so that each area 2a having liquid adhesive can be minimized. In FIG. 6B, small metal films 11a are formed on a surface of the substrate, which surface is opposite to a surface on which the film 2 is formed. The heat generated by each heater 4 is transmitted via each corresponding metal film 11a and the substrate 1 to the film 2.

Next, a description will be give of means for forming a latent image.

As has been described above, the heater source can be a heater, a thermal head or some other types of contact heaters, or a laser light, an infra-red lamp or some other types of non-contact heaters which emit an electromagnetic wave.

The following will be a description of the conceptual structure of the mechanism for heating the surface of the recording medium (A) in the state where a liquid is in contact with the surface of the recording medium (A). A type of the recording medium in which the film 2 is formed on a substrate 1 is used in the following mechanisms.

Figure 7A:
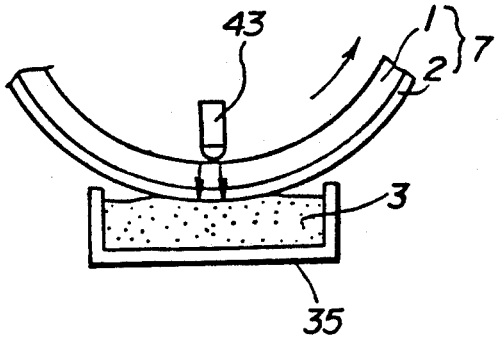
Figure 7B:
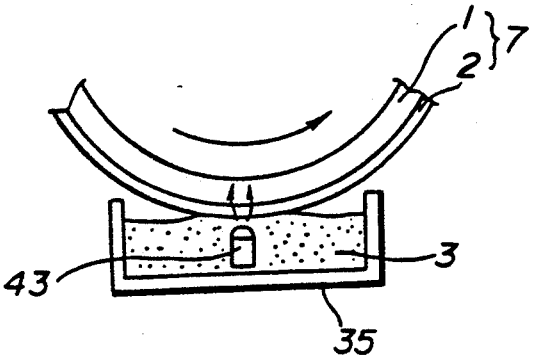
Figure 7C:
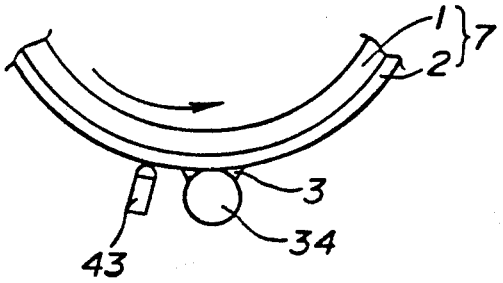
Figure 7D:
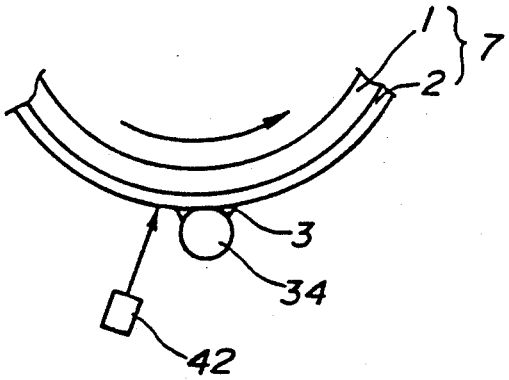

In FIGS. 7A and 7B, a liquid 3 is always in a state of contact with the lower surface of a recording medium 7 which is in a drum shape. Then, in this state, when the recording medium 7 relates, the recording medium 7 is selectively heated in accordance with the image information, from the side of the substrate 1 or the side of the liquid 3. In FIG. 7C, the surface (film 2) of the recording medium 7 is selectively heated in accordance with the image information. Then, immediately after that, the surface of the recording medium 7 is brought into with the liquid 3. In FIG. 7D, the laser beam from a laser light source 42 is used to selectively heat the surface of the recording medium 7.

As shown in FIGS. 7A and 7B, a vat 35 filled with the liquid 3 is provided at the lower portion of the recording medium 7 and the lower surface of the recording medium 7 is always in contact with the liquid 3 in the vat 35. The heat source (a thermal head 43) is mounted in the vat 35 or in the vicinity of the vat 35, so that a structure of this printing mechanism becomes simple. Instead of the vat 35, a sponge type of porous substance 35 filled with the liquid 3 can be provided so that the sponge type of porous substance 35 is in contact with the surface of the recording medium 7. In addition, it is also possible to heat the surface of the recording medium 7 by an electron beam.

As has been described above, the surface of the recording medium 7 is heated and liquid 3 is brought into contact with the surface of the recording medium 7 so that each area with liquid adhesive has a small receding contact angle $\theta_r$ and latent image in accordance with areas with liquid adhesive are formed.

Figure 8:
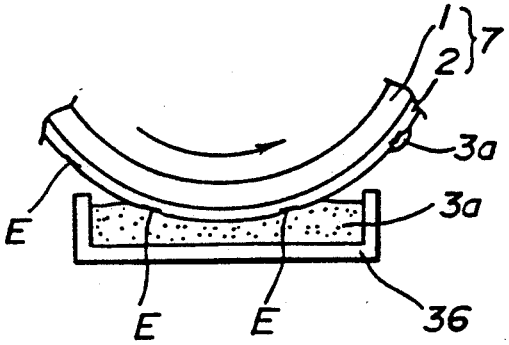
Figure 9:
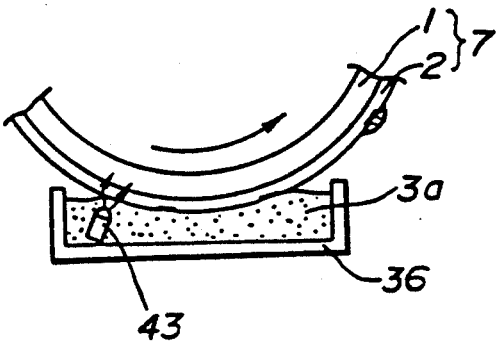

A recording agent (ink) is adhered to each liquid adhesive area selectively formed on the surface of the recording medium 7 in accordance with the image information. A mechanism for adhering the recording agent to each liquid adhesive area has, as shown in FIG. 8, a vat 36 filled with the recording agent 3a. The vat 36 is arranged on a down stream side of the mechanism for forming the latent image in a moving direction of the recording medium 7 so that the recording agent 3a is always in contact with the surface of the recording medium 7. In this mechanism, when the recording medium 7 rotates, the liquid recording agent 3a is adhered to the liquid adhesive area (latent image) E formed as described above. This recording agent 3a which adheres to the surface of the recording medium 7 forms a visible image. In FIG. 9, the liquid recording agent 3a is filled in the vat 36 and is in a state where the surface of the recording medium 7 is always in contact with it. Then, the thermal head 43 selectively heats the surface of the recording medium 7 from the side of the recording agent 3a. In the mechanism shown in FIG. 9, as the recording agent 3a has a function for forming latent image and a function for developing the latent image, the latent image is formed and then the latent image is developed in one process. The printing apparatus having the mechanism shown in FIG. 9 can be made compact.

Figure 10:
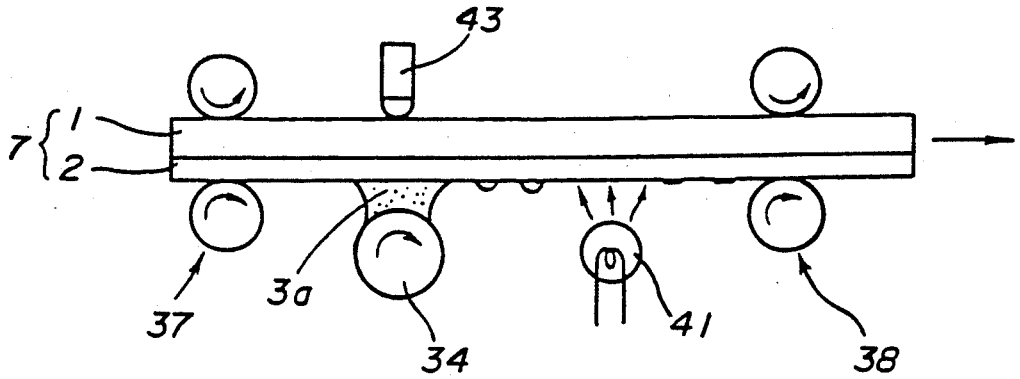

FIG. 10 illustrates an example of the direct formation of a visible image on the surface of the recording medium 7.

Referring to FIG. 10, a flexible film or a rigid film is used as the substrate 1. A stacked structure consisting of the substrate 1 and the film 1 is uses as the recording medium 7. The recording medium 7 is conveyed at a constant speed by rollers 37 and 38. A porous roller 34 into which the recording agent 3a has been impregnated is in contact with the surface of the recording medium (i.e. the film 2). The surface of the substrate 1 of the recording medium 7 is selectively heated in accordance with the image information by a thermal head 43. In a state where the recording agent 3a is in contact with the surface of the film 2, the thermal head 43 selectively heats the film 2 via the substrate 1, so that the latent image is formed on the surface of the film 2 and then the latent image is developed by the recording agent 3a. After that, recording agent 3a (the latent image) adhered to the surface of the film 2 is heated and dried by an infra-red heater 41. The recording agent 3a is fixed on the surface of the film 2 due to the heating and the drying. Therefore, a visible image 3b is formed on the film 2 of the recording medium 7.

Figure 11:
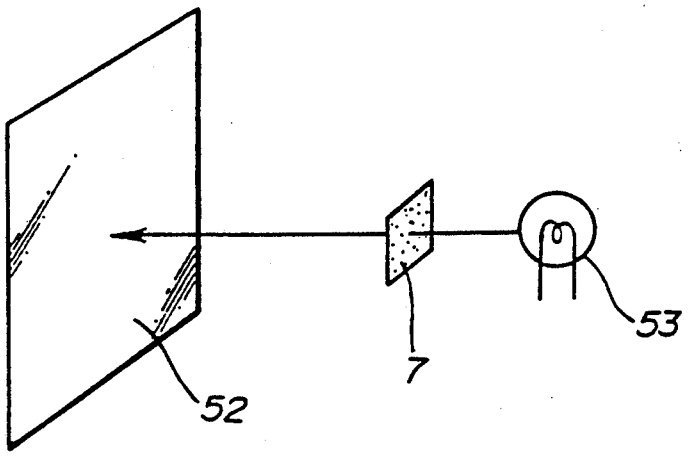
Figure 12:
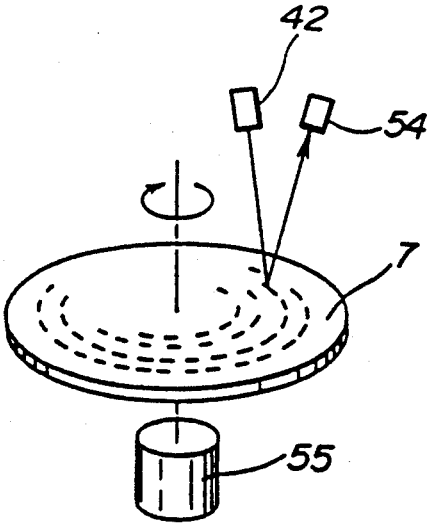

A transparent film can be used as the recording medium. In this case, the transparent film on which the visible image 3b is formed by the recording agent 3a can be, as shown in FIG. 11, used as a slide for projection. That is, when a light is illuminated from a light source 53 which is placed behind the surface of the transparent film, the image 3b on the transparent film is projected onto a screen 52. In addition, as shown in FIG. 12, it is also possible to use the recording medium as an information storage medium. That is, in a state where a disk type recording medium 7 is rotated at a constant speed by a motor 55, a light beam from a laser light source 42 is irradiated to the recording medium 7. It is possible to read the information by detecting the intensity of the light beam reflected in accordance with the visible image 3b on the surface of the recording medium 7.

Figure 13:
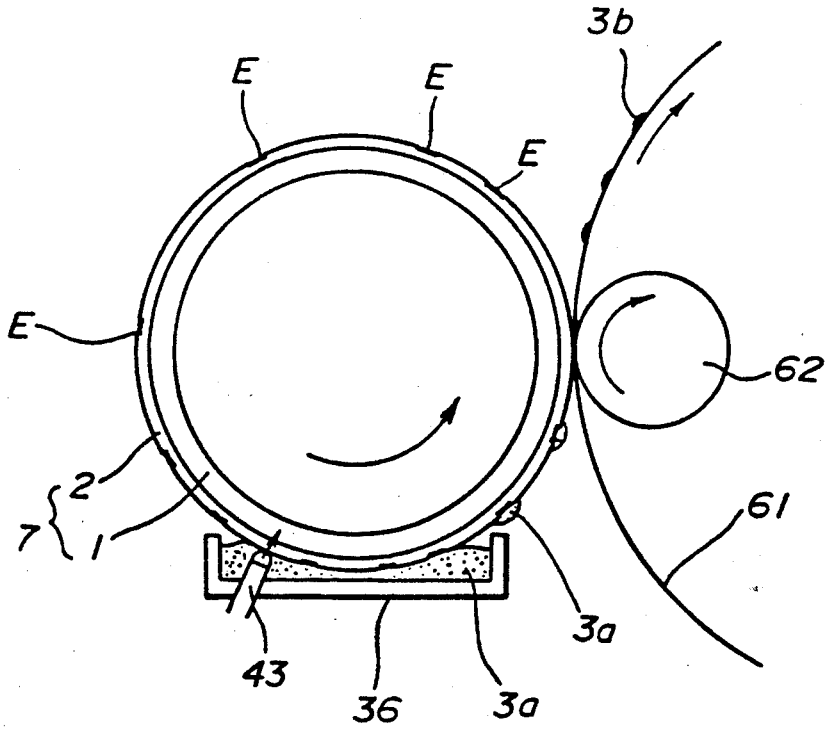
Figure 14:
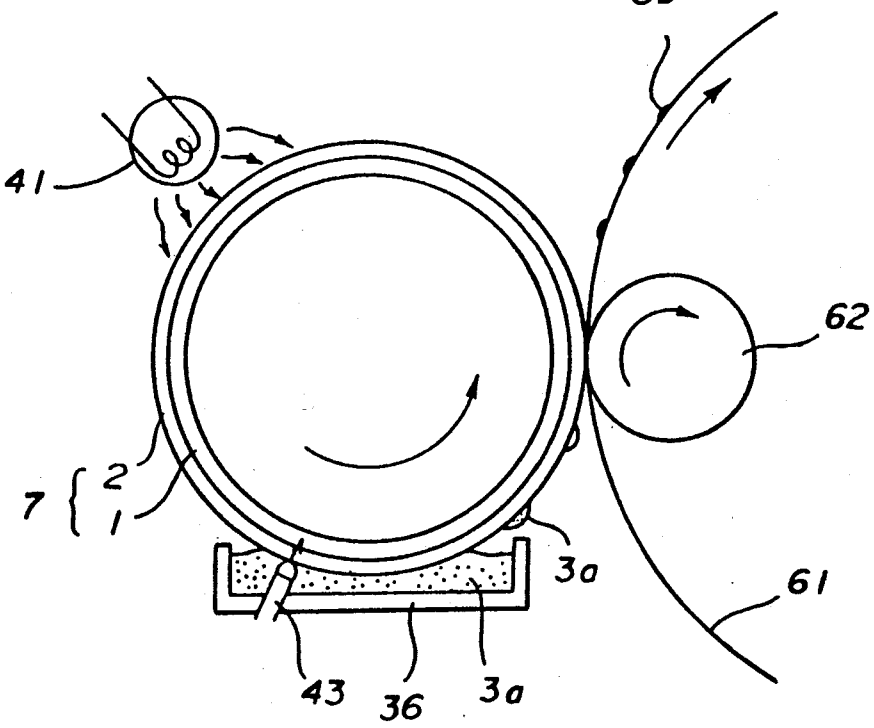

FIGS. 13 and 14 illustrate apparatus having mechanisms for transferring a visible image formed on the recording medium to a recording sheet (the indirect recording process).

In the indirect recording process for transferring a visible image to the recording sheet, it is advantageous to use a rigid cylinder member as the substrate 1.

FIG. 13 illustrate a first printing apparatus. In FIG. 13, the recording agent 3a is filled in the vat 36. In a state where a lower surface of the recording medium 7 is in contact with the recording agent 3a, the recording medium 7 is rotated at a constant speed. A thermal head 43 selectively heats the surface of the recording medium 7 in accordance with the image information. As has been described above, the recording agent 3a adheres to the heated areas of the surface of the recording medium 7 (the film 2). Then, the recording agent 3a adhering to the surface of the recording medium 7 is transferred to the recording sheet 61 fed between the recording medium 7 and a roller 62. The mechanism for transferring the recording agent 3a from the recording medium 7 to the recording sheet 61 is arranged so that the transferring process is carried out after the developing process. It is desirable that the transferring process be carried out immediately after the developing process.

In the printing apparatus shown in FIG. 13, the latent image is not erased from the surface of the recording medium 7, so that the developing process and the transferring process can be repeatedly carried out to enable printing. When the printing of one image has been completed, the exchanging of the recording medium 7 of the latent image erasure enable the printing of a different image.

FIG. 14 illustrates a second recording apparatus in which images can be successively formed. The recording apparatus shown in FIG. 14 has the same mechanisms for forming the latent image, developing the latent image, and transferring the recording agent, as that shown in FIG. 13.

Referring to FIG. 14, after transferring process, in a state where the liquid or the vapor are not present (in air, vacuum or inert gas), an infra-red heater 41 heats the surface of the recording medium 7 on which the latent image is formed. The latent image is erased from the surface of the recording medium 7 due to the heating by the infra-red heater 41. When the latent image is erased from the surface of the recording medium 7, it becomes possible to reuse the recording medium 7 for forming a new image.

In addition, the heating device can be a heater, a thermal head or another contact types of heating devices, but can also be a non-contact type of heating device which use the electromagnetic radiation. The heating can be performed for the entire surface or can be performed only the latent image portion. However, to obtain a compact apparatus, it is desirable that the mechanism for heating the entire surface of the recording medium 7 be provided on the printing apparatus. Moreover, after the surface of the recording medium 7 is heated so as to erase the latent image, the surface of the recording medium 7 is effectively cooled to a normal temperature in a time until the next latent image is formed. The heating temperature which is required for erasing the latent image is determined based on the material of the surface of the recording medium 7. This heating temperature should desirably be a temperature lower than the decomposition point and higher that a temperature at which the receding contact angle starts to decrease of the surface of the recording medium 7. The recording sheet can be a transparent resin film, a plain paper, an ink jet paper, a typing paper or the like.

A description will now be given of the recording agent.

In the recording process for obtaining a visible image on the surface of the recording medium (A), the recording agent can be ink for writing, ink for ink jet printing, printing ink, electrostatic transfer toner or some other recording agent used in conventional printing processes.

Therefore, in the case of the specific example of water-soluble ink, it is possible to use water-soluble ink containing water, humictants and dye as the main components, water based pigment dispersal inks that have water, pigments macromolecule compounds for dispersal and humictants as the main components, or emulsion inks in which pigments or dyes are the surface activated agents that are dispersed in water. The humictants used in water based inks can be any of the following water-soluble organic compounds:

ethanol, methanol, propanol and other monovalent alcohols;

ethylene glycol, diethylene glycol, triethylene glycol, tetraethylene glycol, polyethylene glycol,propylene glycol, dipropylene glycol, glycerine and other multivalent alcohols;

ethylene glycol monobutyl ether, diethylene glycol monomethyl ether, triethylene glycol monomethyl ether, tetraethylene monomethyl ether, propylene glycol monomethyl ether, ethylene glycol, diethylene glycol monoethyl ether, triethylene glycol monoethyl ether, tetraethylene glycol monoethyl ether, propylene glycol monoethyl ether and other multivalent alcohol ethers;

N-methyl-2-pyrrolidone, 1,3-dimethyl-imidazolricinon, ε-caprolactum and other heterocyclic compounds; and monoethanol amine, diethanol amine, triethanol amine, monoethyl amine, diethyl amine, trietyl amine and other amines.

The water-soluble pigment can be a pigment which is classified by the color index into acid pigments, direct pigments, chlorine group pigments, responsive pigments and food pigments.

The examples of pigments indicated as follows.

C.I. acid yellow: 17, 23, 42, 79, 142

C.I. acid red: 1, 8, 13, 14, 18, 26, 27, 35, 37, 42, 52, 82, 87, 89, 92, 97, 106, 111, 114, 115, 134, 186, 249, 254, 289

C.I. acid blue: 9, 29, 45, 92, 249, 890

C.I. acid black: 1, 2, 7, 24, 26, 94

C.I. food yellow: 3, 4

C.I. food red: 7, 9, 14

C.I. food black: 2

C.I. direct yellow: 1, 12, 24, 26, 33, 44, 50, 142, 144, 865

C.I. direct red: 1, 4, 9, 13, 17, 20, 28, 31, 39, 80, 83, 89, 225, 227

C.I. direct orange: 26, 29, 62, 102

C.I. direct blue: 1, 2, 6, 15, 22, 25, 71, 76, 79, 86, 87, 90, 98, 163, 165, 202

C.I. direct black: 19, 22, 32, 38, 51, 56, 71, 74, 75, 77, 154, 168

C.I. basic yellow: 1, 2, 11, 14, 15, 19, 21, 23, 24, 25, 28, 29, 32, 36, 40, 41, 45, 49, 51, 53, 63, 65, 67, 70, 73, 77, 87, 91

C.I. basic red: 2, 12, 13, 14, 15, 18, 22, 23, 24, 27, 29, 35, 36, 39, 46, 51, 52, 54, 59, 68, 69, 70, 73, 78, 82, 102, 104, 109, 112

C.I. basic blue: 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, 155

C.I. basic black: 2, 8

The pigment can be organic pigment such as azo pigment, phtalocyanine pigment, anthraquinone pigment, quinacridon pigment, diexazine pigment, indigo pigment, dioindigo pigment, perynone pigment, perylene pigment, iso-indolenone pigment, aniline black, azomethine azo pigment, carbon block and others. The inorganic pigment can be iron oxide, titanium oxide, calcium carbonate, baruim sulfate, ammonium hydroxide, barium yellow, prussian blue, cadmium red, chrome yellow and metal powder.

The dispersed pigment compounds can be polyacrylamide, polyacryrate and other alkali metallic salt, soluble styrene arcylic resin and their acryl family resin, soluble vinyl napthalene acid resin, polyvinyl pyrrolidone, polyvinyl alcohol, and its alkali salt, macromolecule compound which includes salt with cation functional group such as ammonium and amino group etc., polyethylene oxide, gelatine, casein and other proteins, arabia rubber, traganth rubber and other natural rubber, saponin and other qlucoxyde, carboxy-methyl cellulose, hydroxyethyl cellulose, methyl cellulose and other cellulose inductors, lignin sulfonic acid and its salt, ceramics and other natural macromolecule compounds, and the like.

The oil-based type of recording agents can be those in which lipophilic pigment is dissolved in an organic compound, those in which pigment is dispersed in an organic compound, those in which pigment or colorant is emulsified in an oil base, and the like.

Representative examples of the oil-based type pigments are indicated as follows:

C.I. solvent yellow: 1, 2, 3, 4, 5, 6, 7, 8, 9, 10, 11, 12, 14, 16, 17, 26, 27, 29, 30, 39, 40, 46, 49, 50, 51, 56, 61, 80, 86, 87, 89, 96

C.I. solvent orange: 12, 23, 31, 43, 51, 61

C.I. solvent red: 1, 2, 3, 16, 17, 18, 19, 20, 22, 24, 25, 26, 40, 52, 59, 60, 63, 67, 68, 121

C.I. solvent Violet: 7, 16, 17,

C I solvent blue: 2, 6, 11, 15, 20, 30, 31, 32, 36, 55, 58, 71, 72

C.I. solvent brown: 2, 10, 15, 21, 22

C.I. solvent black: 3, 10, 11, 12, 13

In addition, oil bases in which pigment is dissolved or in which pigment is dispersed include n-octane, n-decan, Milanese spirit, ligroin, naptha, benzene, toluene, xylene and other hydrocarbons; dibytyl ether, dihexyl ether, anisole, phenetole, dibenzyl ether and other ethers; and methanol ethanol, isopropyl alcohol, benzyl alcohol, ethylene glycol, diethylene glycol, glycerin and other alcohols.

It is also possible to use the above described pigments for the oil-based inks as well. Examples of the oil-based pigment dispersal agents include polymethacrylic acid ester, polyacrylic acid ester, methacrylic acid ester-acrylic acid ester copolymer, polyacetic acid vinyl, vynil chloride-vinyl acetate copolymer, polyvinyl pyrrolidone, polyvinyl butyral and other vinyl copolymers, ester cellulose, methyl cellulose and other cellulose resins, polyester, polyamide, phenol resin and other polymer resins, rosin, ceramics, relative, casein and other natural resins and the like.

Figure 15A:
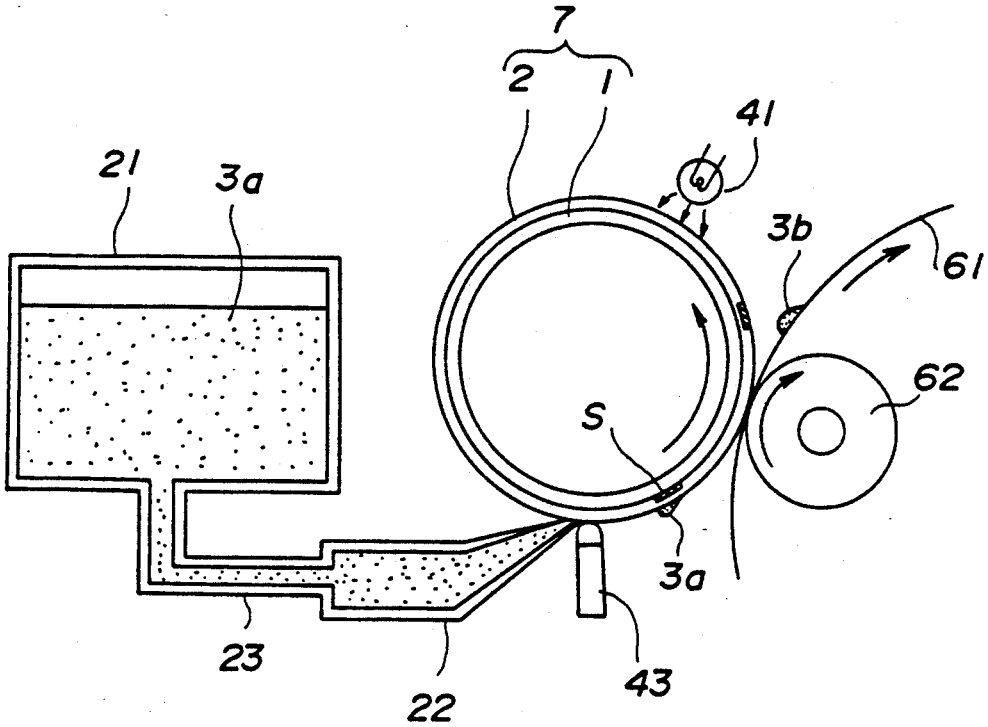
FIG. 15A is a view illustrating an image forming apparatus according to a first embodiment of the present invention.

In the present invention, a mechanism for supplying the recording agent to the surface of the recording medium is further improved. FIG. 15A shows an image forming apparatus according to a first embodiment of the present invention.

Figure 15B:
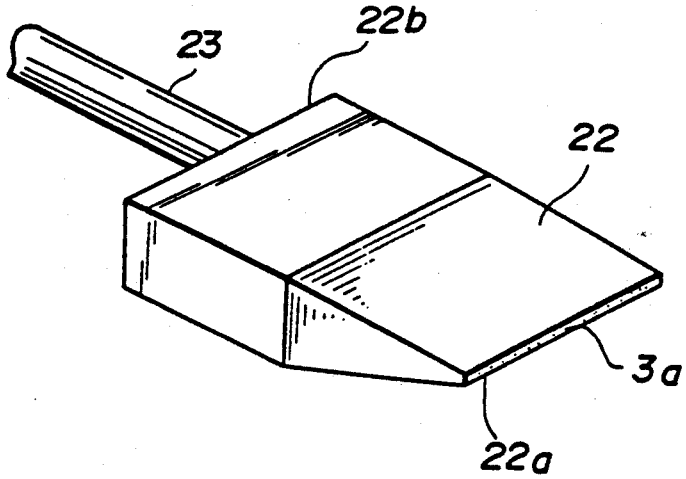
FIG. 15B is a perspective view illustrating a supplying head shown in FIG. 15A.

Referring to FIG. 15A, the drum shaped recording medium 7 comprising the substrate 1 and the film 2, the thermal head 43 for selectively heating the surface of the film 2 the recording sheet 61 to which the recording agent 3a (the ink) adhered to the film 2 is transferred, the roller 62 for feeding the recording sheet 61 in a predetermined direction and the infrared heater 41 for heating the surface of the film 2 to erase the latent image S formed thereon are arranged in the same manner as that shown in FIG. 14. In addition, a supplying mechanism for supplying the recording agent 3a to the surface of the film 2 is provided for the image forming apparatus. The supplying mechanism comprises a reservoir 21 in which the recording agent 3a (the ink) is stored, a supplying head 22 provided adjacent to the thermal head 43 and a connecting tube 23 which connects the reservoir 21 and the supplying head 22. The recording agent 3a is supplied from the reservoir 21 via the connecting tube 23 to the supplying head 22. The supplying head 22 is formed as shown in FIG. 15B. That is, a slit shaped opening is formed on a front end 22a of the supplying head 22 so that the recording agent 3a supplied via a rear end 22b to the supplying head 22 is output from the slit shaped opening at the front end 22a thereof. A flow path for the recording agent 3a in the supplying head 22 becomes gradually narrower towards the front end 22a of the supplying head 22 so that the recording agent 3a flows via the flow path towards a front end portion of the supplying head 22 due to a capillary attraction. The length of the slit shaped opening formed at the front end 22a of the supplying head 22 is approximately equal to the length of the recording medium 7 in a direction parallel to an axis on which the recording medium 7 is rotated.

The supplying head 22 is arranged adjacent to and on the upstream side of the thermal head 43 with respect to a rotation direction of the recording medium 7. The front end 22a of the supplying head 22 is positioned near the surface of the film 2 so that the recording agent 3a which is projected from the slit shaped opening due to the capillary attraction is brought in contact with the surface of the film 2. It is also possible to arrange the supplying head 22 so that the front end 22a thereof is in contact with the surface of the film 2.

Figure 16A:
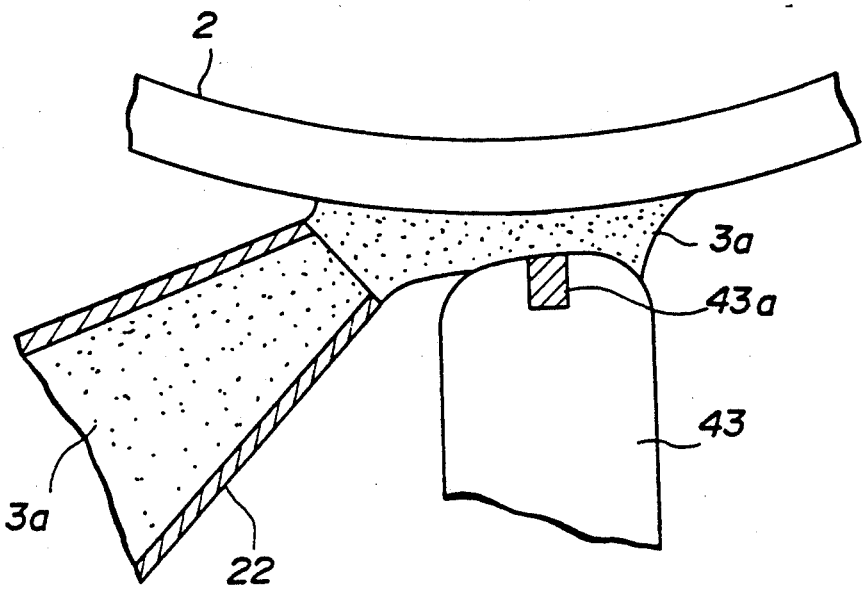
FIGS. 16A and 16B are views illustrating operations in which a liquid is supplied to the surface of the recording medium and adhered thereto.
Figure 16B:
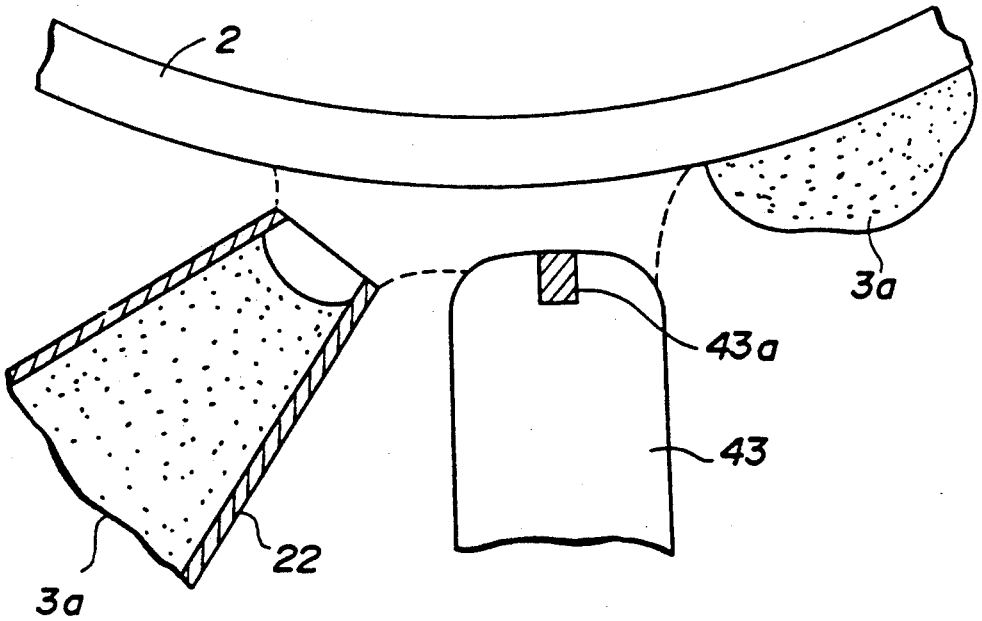

When the recording agent 3a is supplied from the supplying head 22 to the surface of the film 2, a space between the surface of the film 2 and the thermal head 43 is filled with the recording agent 3a, as shown in FIG. 16A. Then, when each thermal element 43a of the thermal head 43 is driven in accordance with the image information, a latent image S is formed on each corresponding area of the surface of the film 2 heated by each thermal element 43a and the recording agent 3a is adhered to the heated area of the film 2. As the recording medium 7 is rotated, the recording agent 3a adhered to the film 2 is separated from the recording agent 3a in the supplying head 22m, as shown in FIG. 16B. Thus, a visible image is formed by the recording agent adhered to the surface of the film 2. When the recording agent adhered to the film 2 is separated from the recording agent in the supplying head 22, the recording agent 3a in the supplying head 22 is rapidly projected from the slit shaped opening due to the capillary attraction and again fills the space between the film 2 and the thermal head 43, as shown in FIG. 16A. The above process in which the recording agent 3a is supplied from the supplying head 22 to the surface of the film 2 (FIG. 16A) and the other above process in which the recording agent adhered to the film 2 is separated from the recording agent in the supplying head 22 (FIG. 16B) are sequentially repeatedly carried out, so that the visible dots of the image are successively formed on the recording medium 7 which is rotated in a predetermined direction.

Then, the visible image formed on the recording medium 7 is transferred to the recording sheet 61. After the transferring of the visible image, the latent image formed on the surface of the film 2 is erased by the heat of the infrared lamp 41.

When the thermal head 43 and the infrared lamp 41 are turned off after the latent image is formed on the surface of the film, each of a plurality of images corresponding to one latent image can be successively formed on each of the corresponding recording sheets.

In the above image forming apparatus, it is also possible to provide the supplying head 22 on the downstream side of the thermal head 43 with respect to the rotation direction of the recording medium 7. In this case, the recording agent 3a is supplied to the area which has been heated by the thermal head 43.

According to the above image forming apparatus, the recording agent 3a such as ink is projected from the supplying head 22 due to the capillary attraction so that the recording agent 3a is supplied to the surface of the recording medium 7. Thus, it is possible to rapidly supply the constant recording agent 3a to the surface of the recording medium without the specific control of the recording agent supply.

Figure 17A:
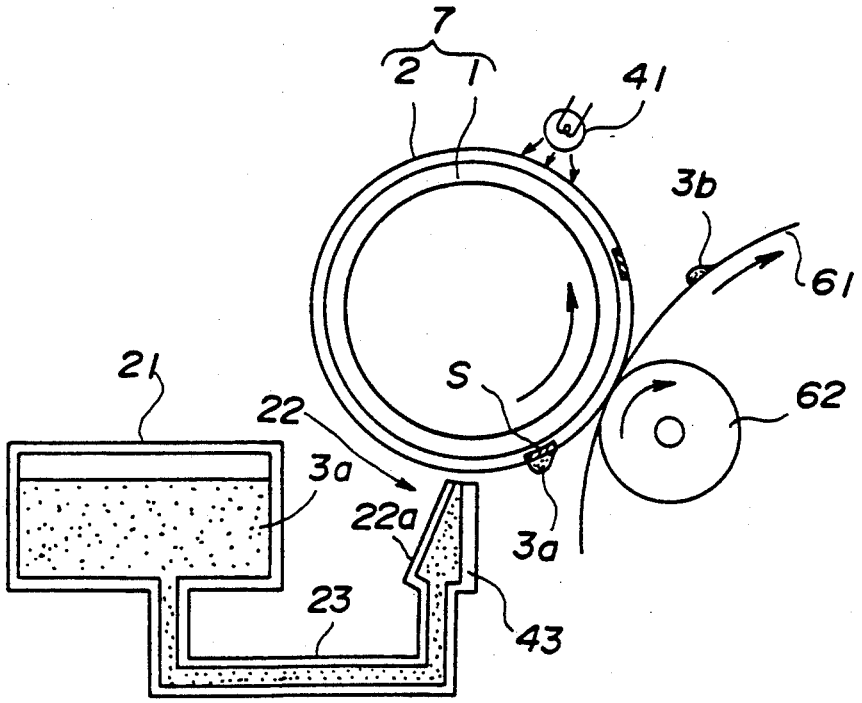
FIG. 17A is a view illustrating an image forming apparatus according to a second embodiment of the present invention.

FIG. 17A shows an image forming apparatus according to a second embodiment of the present invention. In this image forming apparatus shown in FIG. 17A, the thermal head 43 is integrated with the supplying head 22.

Referring to FIG. 17A, the supplying head 22 has substantially the same shape as that shown in FIG. 16B, and a path through which the recording agent 3a flows is formed between a plate 22a and a wall of the thermal head 43. The plate 22a is inclined so that the path between the plate 22a and the wall of the thermal head 43 becomes gradually narrower towards the front end of the supplying head 22. At the front end of the supplying head 22, a slit shaped opening is formed between the plate 22a and the thermal head 43. The recording agent 3a in the supplying head 22 projects from the slit shaped opening formed at the front end of the supplying head 22 due to the capillary attraction. The supplying head 22 is arranged at a position where the recording agent 3a projecting from the slit shaped opening of the supplying head 22 can be in contact with the surface of the film 2. The front end of the supplying head 22 faces the surface of the film 2 so that a normal line of an end surface of the thermal head 43 on which the thermal elements are provided is perpendicular to the surface of the film 2. The recording agent 3a projecting from the slit shaped opening of the supplying head 22 due to the capillary attraction is supplied to a space formed between the surface of the film 2 and the thermal head 43.

Figure 17B:
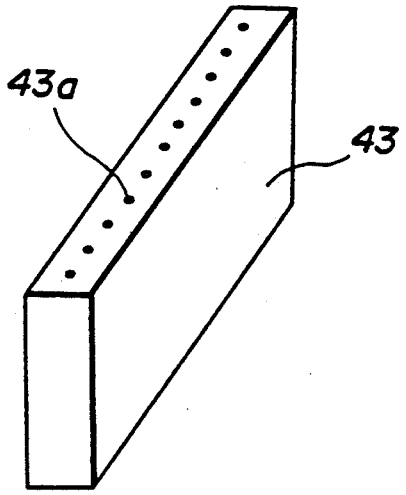
FIG. 17B is a perspective view illustrating a thermal head shown in FIG. 17A.

In the thermal head 43, the thermal elements 43a are arranged in a line on the end surface thereof at regular intervals, as shown in FIG. 17B. The width of the thermal head 43 in a direction parallel to the arrangement direction of the thermal elements 43a is substantially equal to the width of the recording medium 7 in a direction parallel to the axis on which the recording medium 7 is rotated.

In the above mechanism for supplying the recording agent 3a to the surface of the recording medium 7, there are advantages in that the structure thereof is simpler than that of the mechanism shown in FIG. 15A and it is unnecessary to adjust the position of the supplying head 22 relative to that of the thermal head 43 and vice versa.

Figure 18A:
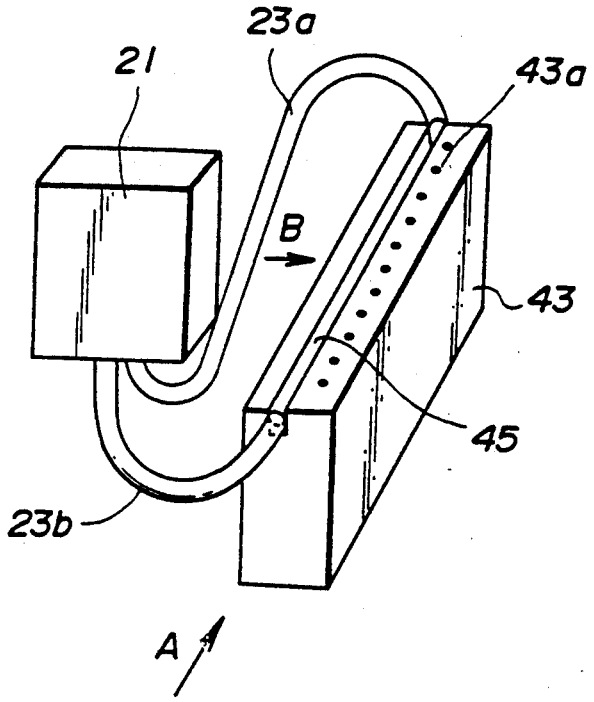
FIG. 18A is a perspective view illustrating a supplying mechanism used in an image forming apparatus according to a third embodiment of the present invention.
Figure 18B:
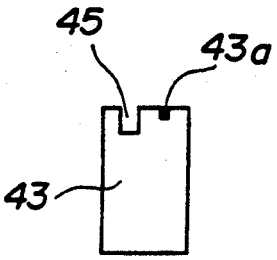
FIG. 18B is a side view of the supplying mechanism shown in FIG. 18A.

FIG. 18A show a supplying mechanism for supplying the recording agent to the surface of the recording medium, according to a third embodiment of the present invention. FIG. 18B is a side view showing a thermal head with respect to a direction indicated by an arrow A in FIG. 18A.

Referring to FIGS. 18A and 18B, a groove 45 is formed in a direction parallel to the arrangement direction of the thermal elements 43 on the end surface of the thermal head 43. A first connecting tube 23a is connected between the reservoir 21 and an end of the groove 45 and a second connecting tube 23b is connected between the reservoir 21 and another end of the grove 45. Thus, the recording agent 3a is supplied from the reservoir 21 via both the first and second connecting tubes 23a and 23b to the groove 45.

The thermal head 43 is arranged adjacent to the recording medium 7 so that the end surface thereof faces the surface of the film 2 in the same manner as the supplying head 22 shown in FIG. 17A. The recording agent 3a projects from an opening of the groove 45 towards the surface of the film 2 due to the capillary attraction, and the recording agent projecting from the opening of the groove 45 is supplied to a space between the surface of the film 2 and a portion of the thermal head 43 on which the thermal elements 43a are arranged in a line.

In the supplying mechanism as shown in FIGS. 18A and 18B, the structure thereof is further simpler than the one shown in FIGS. 17A and 17B.

Figure 19:
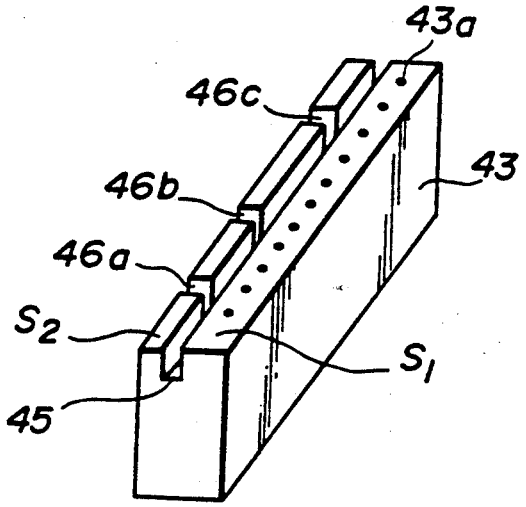
FIG. 19 is a perspective view illustrating a modification of the above third embodiment.

FIG. 19 shows a modification of the thermal head shown in FIGS. 18A and 18B.

Referring to FIG. 19, the end surface of the thermal head 43 is divided by the groove 45 into a first portion $S_1$ on which the thermal elements 43 are arranged in a line and a second portion $S_2$. supplying grooves 46a, 46b and 46c are formed on the second portion $S_2$ of the end surface of the thermal head 43 so as to be connected to the groove 45. In the thermal head 43 having the above structure, the recording agent 3a is supplied via both ends of the groove 45 and the suppling grooves 46a, 46b and 46c to the groove 45.

In the above thermal head 43 shown in FIG. 19, as the recording agent 3a is supplied via five ports—both ends of the groove 45 and the supplying grooves 46a, 46b and 46c—at the same time to the groove 45, when the recording agent 3a has been transferred from the groove 45 to the surface of the film 2, the recording agent 3a can be rapidly supplied via the supplying grooves 46a, 46b and 46c to the groove 45. Thus, it is possible to rapidly form the visible image on the surface of the recording medium 7.

Figure 20:
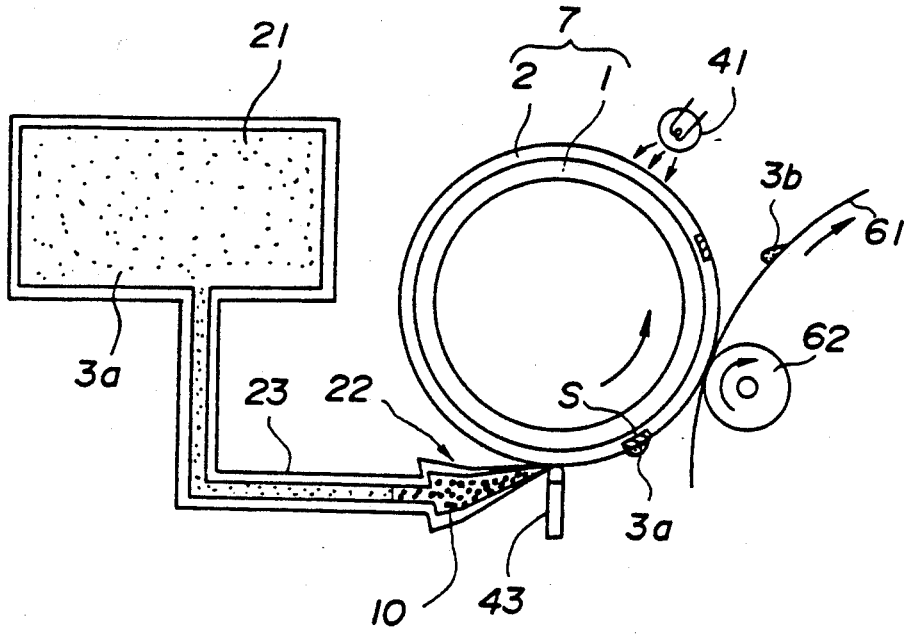
FIG. 20 is a view illustrating a modification of the above first embodiment.

FIG. 20 shows a modification of the supplying mechanism shown in FIG. 15A.

Referring to FIG. 20, the inside of the supplying head 22 is stuffed with a porous member 10. Many narrow paths are reticulately formed in the porous member 10. Each of the narrow paths in the porous member 10 is filled with the recording agent 3a. Then, when the recording agent 3a is adhered to the surface of the recording medium 7 and separated form the supplying head 22, the recording agent 3a projects from an end of each narrow path in the porous member due to the capillary attraction in each narrow path and is supplied to the surface of the recording sheet.

In the above supplying head 22 which is stuffed with the porous member 10, the recording agent 3a can be more stably supplied to the space between the recording medium 7 and the thermal head 43.

The porous member 10 may be also stuffed inside the groove 45 formed on the end surface of the thermal head 43 shown in FIG. 18A or FIG. 19.

As has been described above, according to the above embodiments, as the recording agent in the path formed in the supplying head 22, the groove 45, or the porous member 10 is supplied due to the capillary attraction to the surface of the recording medium, it is possible to rapidly constantly supply recording agent 3a to the surface of the recording medium without the specific control of the recording agent supply.

In the above image forming apparatus, as the surface of the film 2 is heated under a condition where the recording agent 3a is in contact with the surface of the recording film 2, a process for forming a latent image and a developing process for forming a visible image corresponding to the latent image are carried out at substantially the same time. However, the process for forming the latent image and the developing process can be sequentially carried out. In this case, the surface of the film 2 is heated under a condition where the contact material (B), such as water is in contact with the surface of the film 2 during the process for forming the latent image. Each of the embodiments of the supplying mechanism described above can be used as a mechanism for supplying the contact material (B), such as water, to the surface of the recording medium.

Figure 21:
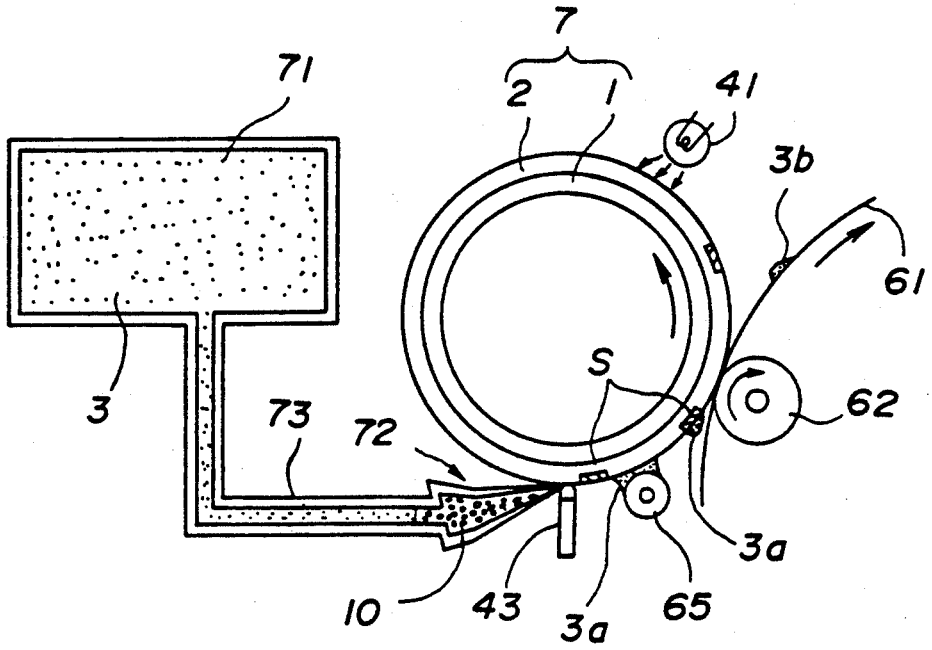
FIG. 21 is a view illustrating an image forming apparatus according to another embodiment of the present invention.

For example, FIG. 21 shows an image forming apparatus having the mechanism for supplying water 3 (the contact material (B)) to the surface of the recording medium .

Referring to FIG. 21, the mechanism for supplying the water 3 to the surface of the recording medium 7 has the same structure as the mechanism for the supplying the recording agent thereto shown in FIG. 20. That is, the water 3 is stored in a reservoir 71 and is supplied via a connecting tube 73 to a supplying head 72. A porous member 10 is stuffed inside the supplying head 72 and filled with the water 3. The water 3 is supplied due to the capillary attraction in each of narrow paths in the porous member 10 from the front end of the supplying head 22 to the space between the recording medium 7 and the thermal head 43, as shown in FIGS. 16A and 16B.

In addition, a porous roller 65 into which the recording agent 3a has been impregnated is provided on the downstream side of the thermal head 43 and in contact with the surface of the recording medium 7. Thus, after an adhesive area S (the latent image) is formed by heating the surface of the film 2 under the condition where the water 3 is in contact with the surface thereof, the recording agent 3a is adhered to the adhesive area S so that the visible image is formed on the surface of the film 2.

In the image recording apparatus described above, liquid adhesive areas to which the liquid such as ink can strongly adhere are formed on the surface of the recording medium so that the latent image is formed thereon. A tacking force with respect to the ink (recording agent) at the liquid adhesive areas is greater than that at other areas on the surface of the recording medium. The visible image is formed by use of a difference between the tacking forces with respect to the ink at the adhesive areas and those of other areas. In this image forming apparatus, the ink does not always adhere to the entirety of each adhesive area, and thus an area to which the ink actually adheres is slightly smaller than each corresponding adhesive area. In addition, a position of the area which the ink actually adheres to slightly differs from a position of each corresponding liquid adhesive area.

Figure 22A:
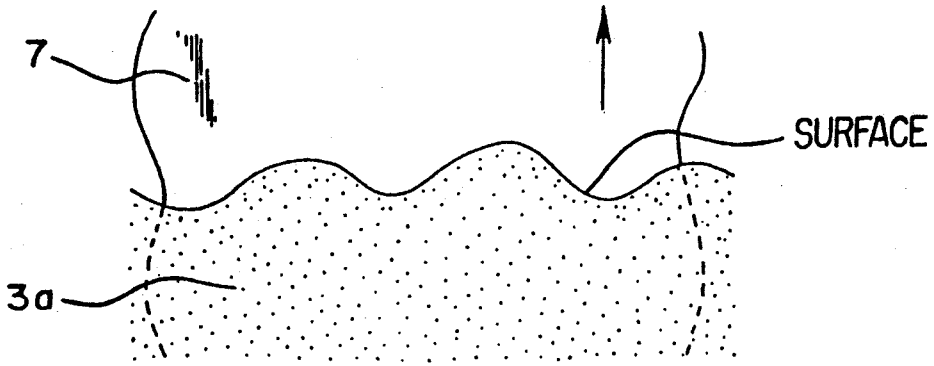
FIGS. 22A and 22B are views illustration a state of a surface of the liquid which is in contact with the recording medium.
Figure 22B:
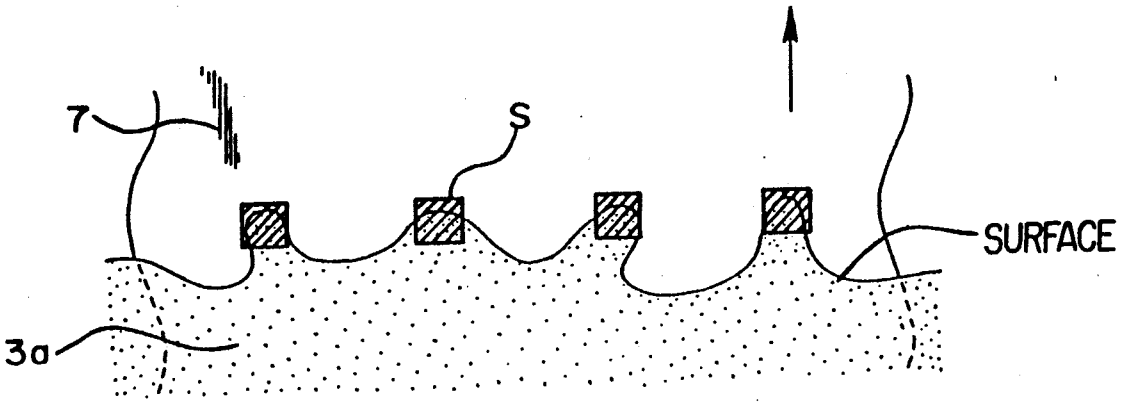

In a case where a part of the surface of the recording medium 7 is soaked in the recording agent 3a stored in the vat 36 so that the recording agent 3a is supplied to the surface of the recording medium 7, as shown in FIGS. 8, 9, 13 and 14, the surface of the recording agent 3a which is in contact with the recording medium 7 is a free surface. Thus, the surface of the recording agent 3a is ununiformly waved when the recording medium 7 is rotated, as shown in FIG. 22A. When the free surface of the recording agent 3a is greatly waved due to a vibration, as shown in FIG. 22B, a varying amount of the recording agent 3a is adhered to the adhesive area S (the latent image) formed on the surface of the recording medium 7 moved in a direction indicated by an arrow. In addition, in this case, the recording agent 3a adhered to the adhesive area S can be easily separated therefrom. Thus, it is difficult to form a fine image on the recording medium 7.

A mechanism for supplying the recording agent to the surface of the recording medium, which is provided for an image forming apparatus according to the present invention, eliminates the above disadvantage.

Figure 23:
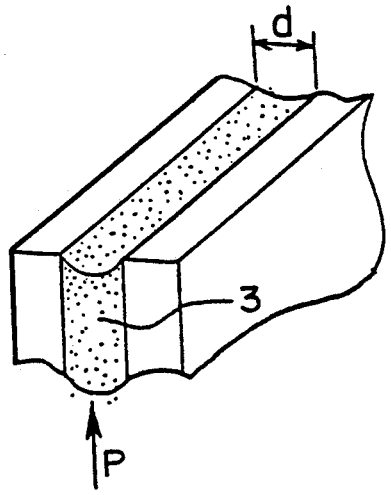
FIG. 23 is a view illustrating a state of the liquid put between two plates.

For example, in a case where there is a liquid between two plates, as shown in FIG. 23, a force F applied to the surface of the liquid is calculated by the following formula, $$F=\pi d\gamma \quad (1)$$

where d is a distance between the two plates and $\gamma$ denotes a surface tension of the liquid. Thus, a pressure $P_o$ due to the surface tension $\gamma$ is denoted by $$P_o=4\gamma/d \quad (2)$$

An internal pressure P is equal to the above pressure $p_o$ due to the surface tension $\gamma$. That is, the following formula stands.

$$P=P_o=4\gamma/d \quad (3)$$

When the internal pressure P varies by $\Delta P$ due to the image forming apparatus vibrating, the internal pressure P is denoted by the following formula.

$$\begin{aligned} P &= P_o + \Delta P \\ &= 4\gamma/d + \Delta P \end{aligned} \quad (4)$$

According to the above formula (4), in a case where the pressure $P_o$ due to the surface tension is large, the degree of an influence which is exerted upon the internal pressure P by the pressure variation $\Delta P$ is small. In this case, even if the pressure variation $\Delta P$ is generated in the liquid, the waves on the surface of the liquid rapidly decrease in intensity.

In the above formula (4), to increase the pressure $P_o$ due to the surface tension, the distance d between the two plates may be decreased. In a case where the distance d between the two plates is small, the capillary attraction in a path which is formed between the two plates is large. That is, the waves on the surface of the liquid can rapidly decrease in intensity due to the capillary attraction.

In addition, when the distance d between the two plates decreases, a fluid resistance of the liquid between the two plates increases. As a result, the waves on the surface of the liquid is further suppressed in intensity.

Due to using the above phenomena, the recording agent (the liquid) can be stably supplied to the surface of the recording medium.

Figure 24A:
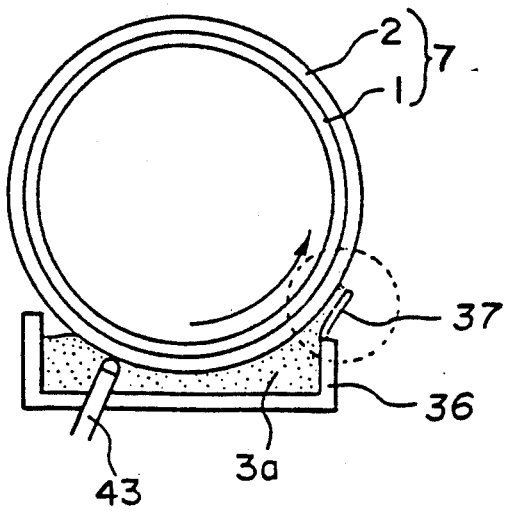
FIG. 24A is a view illustrating an example of the supplying mechanism for supplying recording agent to the surface of the recording medium.

FIG. 24A shows an example of the supplying mechanism for supplying recording agent to the surface of the recording medium.

Referring to FIG. 24A, a part of the surface of the recording medium is soaked in the recording agent 3*a* which is stored in the vat 36. The thermal head 43 heats the surface of the recording medium 7 via the recording agent 3*a*. A blade 37 is provided on an edge of the vat 36 on the downstream side of the thermal head 43 so that the surface of the blade faces the surface of the recording medium 7. A narrow space is formed between the surface of the recording medium 7 and the surface of the blade 37 so that the recording agent 3*a* in the vat 36 is sucked up to the space between the surface of the recording medium 7 and the blade 37 due to the capillary attraction. That is, when the recording agent 3*a* is adhered to the adhesive area formed on the surface of the recording medium 7 and separated from the narrow space between the recording medium 7 and the blade 37, the recording agent 3*a* is supplied to the narrow space between the recording medium 7 and the blade 37 due to the capillary attraction.

In addition, the wavy variation of the surface of the recording agent 3*a* exposed between the surface of the recording medium 7 and an edge portion of the blade 37 is prevented from being generated due to the capillary attraction, as described above.

Figure 24B:
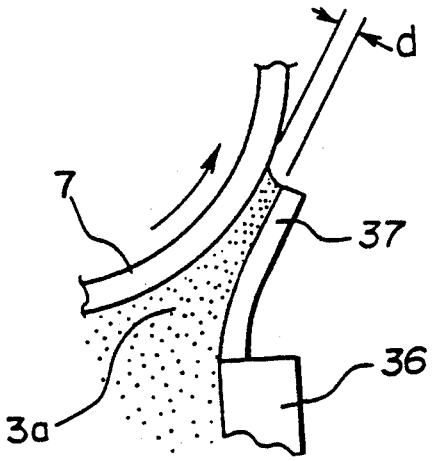
FIG. 24B is a view illustrating a narrow path formed between the surface of the recording medium and the blade.

To efficiently prevent the above wavy variation of the surface of the recording agent 3*a* from being generated, the distance d between the surface of the recording medium 7 and the edge portion of the blade 37, as shown in FIG. 24B, is, for example, determined as follows.

It is assumed that an external vibration is applied to the image forming apparatus so that the image forming apparatus vibrates at an acceleration nG where n is an integer and G is the gravitational acceleration. In this case, the following pressure variation $\Delta P$ is generated due to the acceleration nG in a unit volume of the recording agent 3*a*.

$$\Delta P=nG\rho \quad (5)$$

where $\rho$ denotes the density of the recording agent 3*a*. That is, according to the above formula (4), the internal pressure P is denoted by $$P=4\gamma/d+nG\rho \quad (6)$$

When the pressure $P_o(=4\gamma/d)$ is equal to or greater than the pressure variation $\Delta P$, the wavy variation of the surface of the recording agent 3*a* can be rapidly decreased. That is, $$4\gamma/d \geqq nG\rho. \quad (7)$$

Thus, the distance d is determined as follows.

$$d \leqq 4\gamma/(nG\rho) \quad (8)$$

When the distance d becomes smaller (narrower), the wavy variation of the surface of the recording agent 3*a* can be efficiently suppressed due to the capillary attraction and an operation of the fluid resistance. The optimum distance d is determined in accordance with the above formula (8). It is preferable that the distance d be determined as being a value between 1.0 μm and 1 mm. For example, in a case where the acceleration 5 G is supplied to the image forming apparatus and the surface tension of the recording agent 3*a* is a value between 20 dyn/cm and 70 dyn/cm, the distance d of a value between 0.017 cm (170 μm) and 0.058 cm (580 μm) is determined in accordance with the above formula (8). In the above case, the viscosity of the recording agent is in a range of 1 cp–1000 cp (cp:centipoise). When the acceleration applied to the image forming apparatus is less than 5 G, the distance d can be a value greater than the above value.

Figure 25:
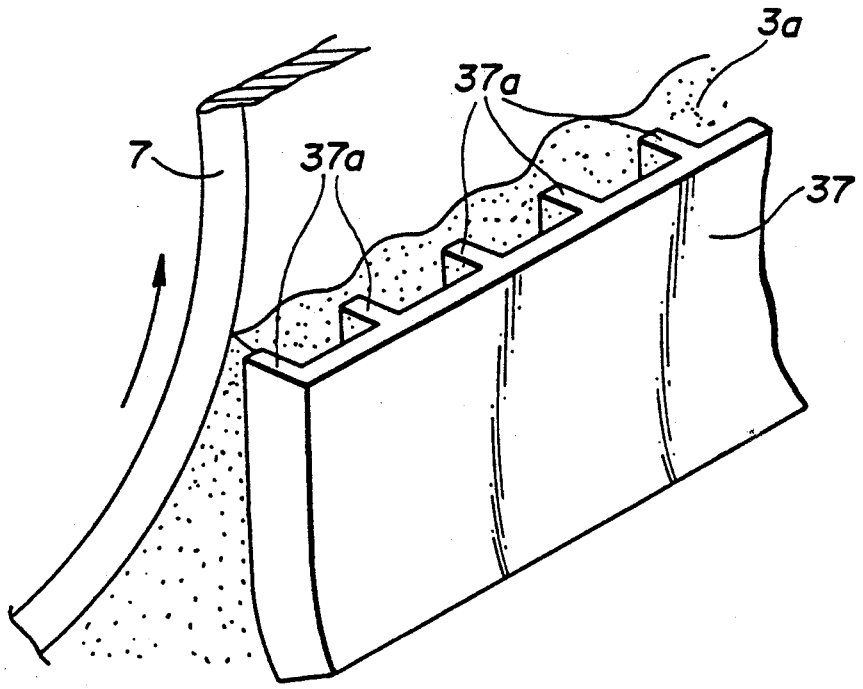
FIG. 25 is a view illustrating a modification of the structure of the above blade shown in FIGS. 24A and 24B.

FIG. 25 shows a modification of the structure of the above blade 37.

Figure 26B:
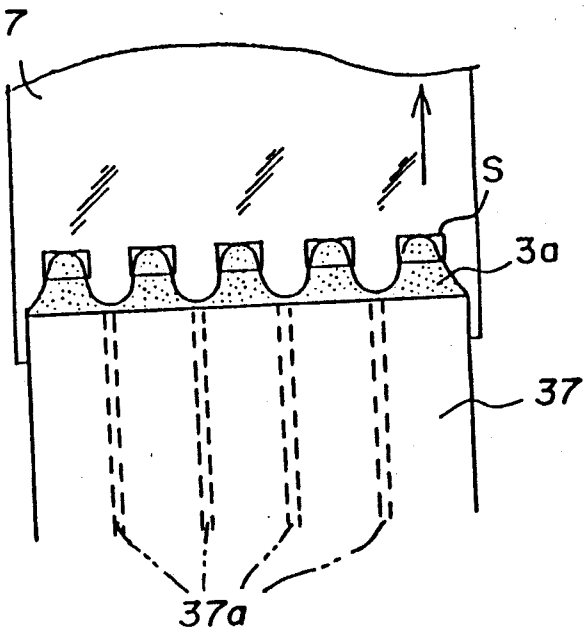
FIGS. 26A and 26B are views illustrating an example of a state where the liquid is adhered to adhesive areas.
Figure 26A:
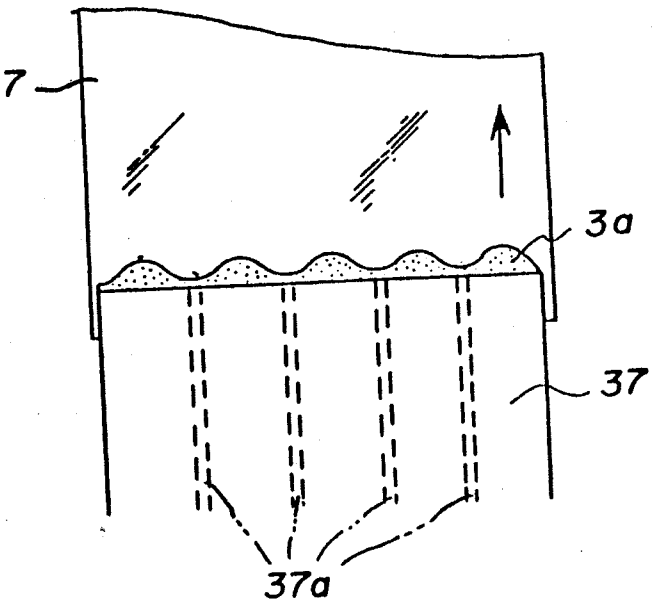

Referring to FIG. 25, a plurality of walls 37*a* project from the surface of the blade 37, which surface faces the surface of the recording medium 7. The walls 37*a* are arranged at predetermined intervals so as to be parallel to each other and so that a concave portion is formed between each pair of adjacent walls 37*a*. The concave portion faces one of adhesive areas formed on the surface of the recording medium 7. In this case, when the recording medium 7 is rotated at a constant speed, a boundary line of the recording agent 3*a* with respect to the surface of the recording medium 7 projects at a position corresponding to each concave portion 37*a* of the blade 37, as shown in FIG. 26A. Each projection portion of the recording agent 3*a* is adhered to each corresponding adhesive area S, as shown in FIG. 26B, so that the recording agent 3*a* can be uniformly adhered to the adhesive areas S formed on the surface of the recording medium 7.

Figure 27:
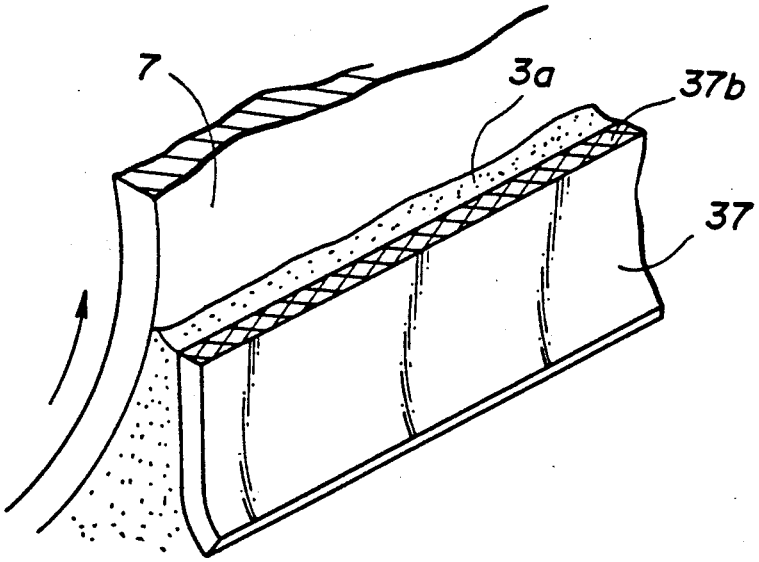
FIG. 27 is a view illustrating another modification of the blade shown in FIGS. 24A and 24B.

FIG. 27 shows a further modification of the blade 37.

Referring to FIG. 27, the surface of the blade 37 which faces the surface of the recording medium 7 has a lyophilic and a end surface 37*b* of the blade 37 has a lyophobic. In this case, as it is difficult for the recording agent 3*a* to adhere to the end surface 37*b* of the blade 37, the wavy variation of the surface of the recording agent 3*a* is more efficiently suppressed. The blade 37 can be formed of metal, glass or resin. The lyophobic on the end surface 37*b* of the blade 37 is, for example, obtained by applying a water and oil repellent thereto, coating fluorocarbon resin thereon by plasma polymerization or the like. The lyophilic on the surface of the blade 37 is, for example, obtained by a corona discharge process, an oxide process, coating a hydrophilic material on the surface, or the like.

Figure 28A:
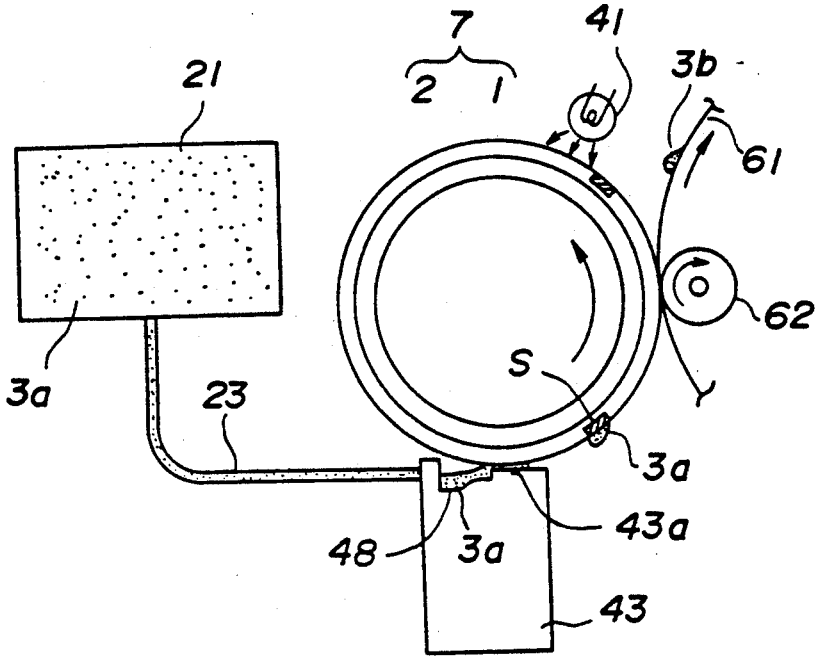
FIG. 28A is a view illustrating an image forming apparatus according to another embodiment of the present invention.

The supplying mechanism for supplying the recording agent to the surface of the recording medium as shown in FIG. 28A also has a function in which the wavy variation of the surface of the recording agent can be suppressed.

Figure 28B:
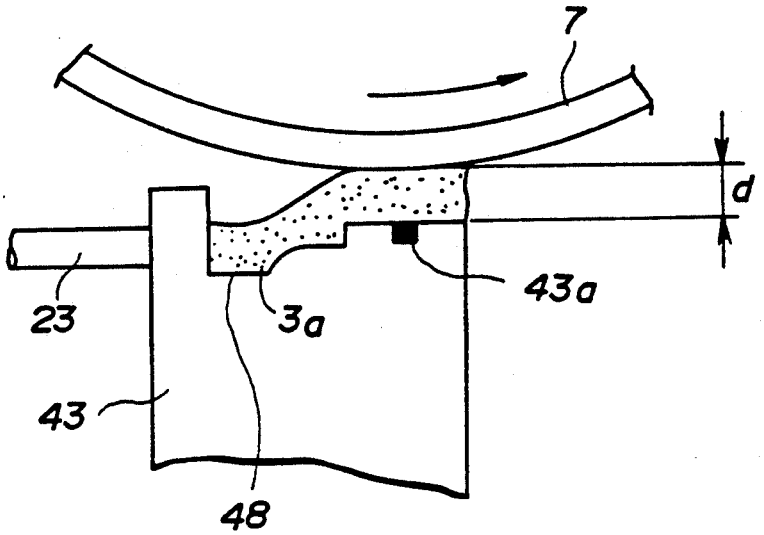
FIG. 28B is an enlarged view illustrating a space between the surface of the recording medium and the end surface of the thermal head shown in FIG. 28A.

Referring to FIG. 28A, a concave portion 48 is formed on the end surface of the thermal head 43 so as to be adjacent to a portion on which the thermal elements 43*a* are arranged. The recording agent 3*a* is supplied from the reservoir 21 via the connecting path 23 to the concave portion 48 of the thermal head 43. The width of the thermal head 43 is substantially equal to the width of the recording medium 7 in a direction parallel to an axis around which the recording medium 7 is rotated. Further, the width of the connecting path is substantially equal to the width of the thermal head 43. The thermal head 43 is arranged so that the distance d between the surface of the recording medium 7 and the surface of the thermal elements 43*a* is a predetermined value, as shown in FIG. 28B. The distance d is, for example, determined in accordance with the above formula (8).

In this case, when the recording agent 3*a* is adhered to the surface of the recording medium 7 which is rotated in a predetermined direction and separated from the space between the recording medium 7 and the thermal head 43, the recording agent 3*a* is supplied from the concave portion 48 to the space between the surface of the recording medium 7 and the thermal elements 43*a* of the thermal head 43 due to the capillary attraction. In addition, due to the capillary attraction and the fluid resistance in the space between the recording medium 7 and the thermal elements 43*a*, the wavy variation of the surface of the recording agent 3*a* exposed between the surface of the recording medium 7 and an end of the thermal head 43 is also efficiently suppressed.

EXAMPLES

Example 1

Polyimide resin was coated on the surface of a cylinder of $\phi$ 100 which was formed of aluminum so that the substrate 1 was formed. The recording layer (the film 2) was made of methacrylate including fluorine (TEXGARD TG-702 manufactured by DAIKIN MANUFACTURING CO., LTD.). Then the recording layer was coated on the polyimide resin layer of the substrate 1, and a stacked structure consisting of the substrate 1 and the recording layer was dried at 90° C. for 30 min., so that the recording medium was formed. The recording medium was heated via the water-soluble ink by the thermal head (8 dots/mm), as shown in FIG. 15A. In a case where the width of a driving pulse signal supplied to each thermal element 43*a* of the thermal head 43 was 0.5 msec., and the level (voltage) of the pulse signal was 12 v, a fine image which was formed on the recording sheet was obtained.

Example 2

The recording medium was formed in the same manner as that used in Example 1. The recording medium, which moved at a speed of 50 mm/sec., was heated via the water-soluble ink by the thermal head (8 dots/mm), as shown in FIG. 17A. In a case where the width of the driving pulse signal was 0.5 msec., and the level of the driving pulse signal was 12 v, a fine image which was formed on the recording medium was obtained.

Example 3

A vibrator applied a rectangular shaped vibration to the image forming apparatus shown in FIG. 24A at an acceleration of 5G. The water-soluble ink, in which the surface tension thereof was dyn/cm and the viscosity thereof was 20 cp, was used as the recording agent 3*a*. The respective image printing quality results for various distances d (gaps) between the blade 37 and the surface of the recording medium 7 were obtained, and are indicated in the following Table.

TABLE

| GAP (μm) | IMAGE PRINTING QUALITY |
|---|---|
| 10 | VERY FINE |
| 50 | VERY FINE |
| 100 | FINE |
| 400 | DOT SIZE SLIGHTLY VARIED |
| 1000 | DOT SIZE VARIED & DIRTY |

Example 4

The material for the film 2 was a copolymer formed of perfluorometyl methacrylate monomer ("Viscoat 17F" manufactured by OSAKA ORGANIC CHEMICAL CO., LTD.) in 1-1-1 trichloroethan liquid. This material was then dissolved in freon 113 ("FREON TF" manufactured by MITSUI FLUORO CHEMICAL CO., LTD.) so that 7 wt. % coating liquid was produced. This coating liquid was then cast on a polyimide film and the film was wound on the surface of the cylinder $\phi$ 100mm) made of aluminum so that the recording medium 7 as shown in FIG. 24A was formed. The thermal head in which the thermal elements 43*a* were arranged at a rate of 8 dots/mm was used. The ink containing a black acid dye (viscosity : 6 cp, surface tension : 45 dyn/cm) was used as the recording agent. A part of the recording medium 7 was soaked in the ink stored in the vat 36, which was made of polyethylen, and the thermal head 43 was mounted so as to be in contact with the surface of the recording medium 7, as shown in FIG. 24A. The blade 37, which was made of stainless steel, was mounted on the end portion of the vat 36 so that the distance d between the surface of the recording medium 7 and the edge portion of the blade 37 was approximately equal to 5.0 μm.

The above image forming apparatus recorded an image in a state where the image forming apparatus was vibrated by the vibrator. As a result, the recorded image was not disordered even if the image forming apparatus was vibrated at an acceleration of 3G.

Example 5

The image forming apparatus having the same structure as that used in Example 4 was used. The blade 7 was made of glass and had approximately a 2 mm thickness. The end surface 37*b* of the blade 37 was coated with a water and oil repellent ("FRORAD FC-721" manufactured by SUMITOMO-3M CO., LTD.), as described in FIG. 27. The distance d between the surface of the recording medium 7 and the blade 37 was approximately 0.5 mm. An oily ink in which the viscosity was 20 cp and the surface tension was 40 dyn/cm was used as the recording agent 3*a*. The solvent of the oily ink was n-octane and the pigment thereof was carbon black.

When the above image forming apparatus was vibrated by the vibrator in the same manner as that used in Example 4, the recorded image was not disordered even if the image forming apparatus was vibrated at an acceleration of 4.5G.

Example 6

The image forming apparatus having the same structure as that used in Example 4 was used. The blade was formed of a photosensitive resin. The photosensitive resin was exposed so that a plurality of concave portions were formed at intervals of approximately 125 μm interval on the surface of the blade 37, as shown in FIG. 27. Each concave portion had a depth of approximately 50 μm and a width of approximately 110 μm. The black water-soluble ink in which the viscosity was 2.0 cp and the surface tension was 45 dyn/cm was used as the recording agent.

When the above image forming apparatus recorded an image, the variation in the size of the ink dot which was adhered to the adhesive area formed on the surface of the recording medium was much smaller than that of the ink dot formed by an image forming apparatus without the blade. The image recorded by the above image forming apparatus was not disordered even if the image forming apparatus was vibrated at an acceleration of 4G.

Comparison example

While the image forming apparatus without the blade was being vibrated by the vibrator, the image forming apparatus recorded an image. As a result, the recorded image was disordered at an acceleration of 0.2G.

What is claimed is:

1. An image forming apparatus comprising:

a recording medium having a recording layer which has a characteristic in which a receding contact angle decreases when said recording layer is heated in a condition where said recording layer is in contact with a liquid, said recording medium being moved by an external driving mechanism in a predetermined direction;

supplying means, coupled to said recording medium, for supplying a liquid to a predetermined area on a surface of said recording layer of said recording medium, said supplying means comprising a narrow path for leading the liquid to the surface of said recording layer due to a capillary attraction; and heating means, coupled to said recording medium, for selectively heating the surface of said recording layer of said recording medium in accordance with image information, wherein an area on the surface of said recording layer is heated and brought in contact with the liquid supplied by said supplying means so that the area changes to a liquid adhesive area to which the liquid can be easily adhered due to the decreasing of the receding contact angle, and wherein a visible image corresponding to the image information is formed on the surface of said recording layer when a recording agent is adhered to the liquid adhesive area.

2. An image forming apparatus as claimed in claim 1, wherein the liquid supplied from said supplying means to the surface of said recording layer is a recording agent including a colorant, so that the liquid recording agent supplied from said supplying means is adhered to the adhesive area formed on the surface of said recording layer and the visible image is obtained on the surface of the recording layer.

3. An image forming apparatus as claimed in claim 1, wherein said supplying means comprises a reservoir for storing the liquid, a supplying head provided adjacent to the surface of said recording layer and a connecting path connecting said reservoir and said supplying head so that the liquid is led from said reservoir through said connecting path to said supplying head, said narrow path being formed in said supplying head so that the liquid is supplied through the narrow path in the supplying head to the surface of the recording layer due to the capillary attraction.

4. An image forming apparatus as claimed in claim 3, wherein a porous member in which a plurality of narrow paths are reticulately formed is provided in said supplying head and the liquid is supplied through each narrow path in the porous member to the surface of the recording layer due to the capillary attraction.

5. An image forming apparatus as claimed in claim 3, wherein said heater means includes a thermal head block having an end surface on which a plurality of thermal elements are arranged in a line, and wherein said supplying head has a plate and is integrated with said thermal head block so that said narrow path is formed between the plate and a wall of said thermal head block, said supplying head being arranged so that the end surface of said thermal head block faces the surface of the recording layer, the liquid projecting from the narrow path being supplied to a space between the end surface of the thermal head and the surface of said recording layer.

6. An image forming apparatus as claimed in claim 3, wherein said heater means includes a thermal head block having an end surface on which a plurality of thermal elements are arranged in a line, said thermal head block being provided adjacent to the surface of said recording layer so that the end surface thereof faces the surface of the recording layer, and wherein said supplying head is formed in said thermal head block, said supplying head including a groove formed on the end surface of said thermal head block along the thermal elements, said groove to which the liquid is led through said connecting path functioning as said narrow path so that the liquid projected from said groove due to the capillary attraction is supplied to a space between a portion where the thermal elements are formed and the surface of said recording layer.

7. An image forming apparatus as claimed in claim 1, wherein said supplying means comprises storing means for storing the liquid in which a part of the surface of said recording layer is soaked, and a plate member provided adjacent to the surface of said recording layer so that said narrow path is formed between the surface of the recording layer and said plate member, the liquid stored in said storing means being led from said storing means into said narrow path and maintained therein due to the capillary attraction.

8. An image forming apparatus as claimed in claim 7, wherein a distance between said surface of said recording layer and said plate member of said supplying means is a value between 1.0 μm and 1 mm.

9. An image forming apparatus as claimed in claim 7, wherein an end surface of said plate member which is positioned at an end of said narrow path has a lyophobic characteristic.

10. An image forming apparatus as claimed in claim 9, wherein a surface of said plate member which faces the surface of the recording layer has a lyophilic characteristic.

11. An image forming apparatus as claimed in claim 7, wherein said plate member has a plurality of walls projecting from a surface thereof which faces the surface of said recording layer, said walls being arranged at predetermined intervals so that a concave portion is formed between each pair of adjacent walls.

12. An image forming apparatus as claimed in claim 11, wherein the concave portion formed between each pair of adjacent walls faces one of a plurality of adhesive areas formed on the surface of said recording layer.

13. An image forming apparatus as claimed in claim 1, wherein said heating means includes a thermal head block having an end surface on which a plurality of thermal elements are arranged in a line, said thermal head block being provided adjacent to the surface of said recording layer, wherein said supplying means comprises a reservoir for storing the liquid, a concave portion formed on the end surface of said thermal head block adjacent to the thermal elements, and a connecting path connecting said reservoir and said concave portion formed on the end surface of said thermal block so that the liquid stored in said reservoir is supplied through said connecting path to said concave portion, and wherein said thermal head is provided adjacent to the surface of said recording layer so that said narrow path is formed between the surface of said recording layer and the end surface of said thermal head, whereby the liquid stored in said concave portion is led from said concave portion into said narrow path and maintained therein due to the capillary attraction.

* * * * *